US011998039B2

(12) United States Patent
Williams

(10) Patent No.: US 11,998,039 B2
(45) Date of Patent: Jun. 4, 2024

(54) GARNITURE WITH INSERT

(71) Applicant: Altria Client Services LLC, Richmond, VA (US)

(72) Inventor: Dwight D. Williams, Powhatan, VA (US)

(73) Assignee: Altria Client Services LLC, Richmond, VA (US)

( * ) Notice: Subject to any disclaimer, the term of this patent is extended or adjusted under 35 U.S.C. 154(b) by 822 days.

(21) Appl. No.: 17/076,094

(22) Filed: Oct. 21, 2020

(65) Prior Publication Data

US 2022/0117292 A1 Apr. 21, 2022

(51) Int. Cl.
*A24C 5/18* (2006.01)

(52) U.S. Cl.
CPC ..... *A24C 5/1878* (2013.01); *A24C 5/1857* (2013.01)

(58) Field of Classification Search
CPC .... A24C 5/1807; A24C 5/1857; A24C 5/1878
See application file for complete search history.

(56) References Cited

U.S. PATENT DOCUMENTS

| | | | | |
|---|---|---|---|---|
| 3,485,144 A | | 12/1969 | Willis et al. | |
| 4,010,762 A | | 3/1977 | Strydom | |
| 6,152,145 A | * | 11/2000 | Focke | A24C 5/1807 198/833 |
| 7,117,871 B2 | | 10/2006 | Hancock et al. | |
| 7,234,471 B2 | | 6/2007 | Fitzgerald et al. | |
| 7,281,540 B2 | | 10/2007 | Barnes et al. | |
| 2005/0039764 A1 | * | 2/2005 | Barnes | A24C 5/20 131/284 |
| 2019/0261675 A1 | * | 8/2019 | McElhinney | A24C 1/18 |
| 2021/0368856 A1 | * | 12/2021 | Sirani Fornasini | A24C 5/20 |

FOREIGN PATENT DOCUMENTS

WO WO-2020025699 A1 * 2/2020 ..... A24C 5/002

OTHER PUBLICATIONS

Calleson, Donald A., "Tow-Guide Insert for NWA Steam Garniture" *Legacy Tobacco Documents Library*, Feb. 18, 1980.

* cited by examiner

*Primary Examiner* — Eric Yaary
(74) *Attorney, Agent, or Firm* — Harness, Dickey & Pierce, P.L.C.

(57) ABSTRACT

The garniture includes at least one first garniture section with a first longitudinal length and a first upper surface, a first groove being defined within the first upper surface along the first longitudinal length, the first groove being defined by one or more first mating surfaces, and at least one first insert overlaying the first groove, an upper end of the at least first insert defining a second groove within a second upper surface of the at least one first insert, a lower end of the at least one insert including one or more second mating surfaces, a first upper portion of the first upper surface and a second upper portion of the second upper surface being substantially flush with each other.

31 Claims, 21 Drawing Sheets

(VIEW A-A)

(VIEW B-B)

(VIEW C-C)

(VIEW D-D)

GARNITURE WITH INSERT

BACKGROUND

Field

Example embodiments generally relate to a garniture with insert.

Description of Related Art

During a machine-made manufacture of cigars, tobacco can be transported through a rod forming apparatus using a belt. The belt may be supported by a garniture.

SUMMARY

At least one example embodiment is directed toward a garniture.

In one example embodiment, the garniture includes at least one first garniture section with a first longitudinal length and a first upper surface, a first groove being defined within the first upper surface along the first longitudinal length, the first groove being defined by one or more first mating surfaces; and at least one first insert overlaying the first groove, an upper end of the at least first insert defining a second groove within a second upper surface of the at least one first insert, a lower end of the at least one insert including one or more second mating surfaces, a first upper portion of the first upper surface and a second upper portion of the second upper surface being substantially flush with each other.

In one example embodiment, the first upper portion of the first upper surface and the second upper portion of the second upper surface are substantially flat surfaces.

In one example embodiment, each of the one or more first mating surfaces is connected to and flush with a respective one of the one or more second mating surfaces.

In one example embodiment, no gaps exist between the one or more first mating surfaces and each respective one of the one or more second mating surfaces.

In one example embodiment, each of the one or more first mating surfaces are flat surfaces that span across the first longitudinal length.

In one example embodiment, the first groove has a first vertical cross-sectional profile with two or more flat sides, and each one of the two or more flat sides is at an obtuse angle relative to a directly adjacent one of the two or more flat sides.

In one example embodiment, the one or more first mating surfaces includes: a lower surface, the lower surface existing in a first plane that is about parallel with the first upper portion of the first upper surface, and a first surface and a second surface each extending from the lower surface to the first upper portion of the first upper surface, the first surface and the second surface each existing in respective planes that are at obtuse angles relative to the lower surface and the first upper portion of the first upper surface.

In one example embodiment, the at least one first garniture section includes: a first garniture section; and a second garniture section, the at least one first insert overlaying both the first garniture section and the second garniture section.

In one example embodiment, the garniture further includes a third garniture section, a third groove being defined within a third upper surface of the third garniture section; and a fourth garniture section, a fourth groove being defined within a fourth upper surface of the fourth garniture section, wherein the first garniture section, the second garniture section, the third garniture section and the fourth garniture section are contiguously connected so that the second groove is in communication with the third groove and the fourth groove.

In one example embodiment, the second groove, the third groove and the fourth groove each have an arcuate-shaped vertical cross-sectional profile, and a width of at least one of the second groove, the third groove or the fourth groove varies along a respective length of the first garniture section, the second garniture section, the third garniture section or the fourth garniture section.

In one example embodiment, the second groove, the third groove and the fourth groove each have an arcuate-shaped vertical cross-sectional profile, and the third garniture section includes a first end and a second end, the third groove spanning from the first end to the second end, wherein a width of the third groove narrows from a first width on the first end to a second width on the second end of the third garniture section, the second groove and the fourth groove both having a third width that is equal to the second width.

In one example embodiment, a third width of the second groove varies along the first longitudinal length of the at least one first garniture section.

In one example embodiment, the second groove has a second vertical cross-sectional profile that is arcuate-shaped.

In one example embodiment, the at least one first insert has a second longitudinal length, the second longitudinal length being a same length as the first longitudinal length.

In one example embodiment, the at least one first insert has a second longitudinal length, and the at least one first insert is one continuous insert that does not include seams along the second longitudinal length.

In one example embodiment, the at least one first garniture section defines at least one cooling hole that traverses through a first end and a second end of the at least one first garniture section, the at least one cooling hole running through the first longitudinal length of the at least one first garniture section.

In one example embodiment, the at least one cooling hole is below the first groove, adjacent to the first groove, or below and adjacent to the first groove.

In one example embodiment, the first groove has a fourth width and a first depth within the at least one first garniture section, the fourth width being about perpendicular to the first longitudinal length and the first depth being based on a lowest elevation of the first groove; and about 5% to about 35% of a total vertical cross-sectional area of the at least one cooling is within the fourth width and the first depth of the first groove.

In one example embodiment, about 10% to about 25% of the total vertical cross-sectional area of the at least one cooling is within the fourth width and the first depth of the first groove.

In one example embodiment, the at least one cooling hole includes: a first cooling hole; and a second cooling hole, the first cooling hole and the second cooling hole being symmetrically positioned relative to the first groove.

At least one example embodiment is directed toward a finishing section of a rod forming apparatus that includes the garniture; finishing stations; and a lower belt, wherein the finishing stations are on the garniture, the lower belt being configured to travel through the second groove and between the garniture and the finishing stations.

In one example embodiment, the finishing stations include: a compression box; at least one folder; and a heater, wherein the at least one folder is on the at least one first garniture section.

In one example embodiment, the at least one first garniture section includes: a first garniture section; and a second garniture section, the at least one first insert spanning across the first garniture section and the second garniture section.

In one example embodiment, the garniture further includes: a third garniture section, a third groove being defined within a third upper surface of the third garniture section; and a fourth garniture section, a fourth groove being defined within a fourth upper surface of the fourth garniture section, wherein the first garniture section, the second garniture section, the third garniture section and the fourth garniture section are contiguously connected so that the second groove is in communication with the third groove and the fourth groove.

In one example embodiment, the compression box and the heater are on the third garniture section and the fourth garniture section, respectively.

In one example embodiment, the lower belt is configured to transport a column of tobacco on at least one covering through the finishing section, the compression box is configured to compress the column of tobacco into a tobacco rod, and the at least one folder is configured to longitudinally cover the tobacco rod with the at least one covering to form a wrapped tobacco rod, the wrapped tobacco rod having a desired diameter.

In one example embodiment, the lower belt is configured to transport a column of tobacco on at least one covering through the finishing section, and the finishing stations are configured to compress the column of tobacco into a tobacco rod and longitudinally wrap the tobacco rod with the at least one covering.

In one example embodiment, the garniture includes at least one second garniture section, and the finish stations include, at least one first station that is configured to wrap the tobacco rod with the at least one covering, at least one second station that is configured to form the tobacco rod or further process the tobacco rod besides wrapping the tobacco rod, and the at least one first station is on the at least one first garniture section, and the at least one second station is on the at least one second garniture section.

In one example embodiment, wherein a fifth width of the second upper portion of the second upper surface is wide enough to prevent the lower belt and the at least one covering from contacting the first upper portion of the first upper surface while the finishing section is in operational use.

In one example embodiment, wherein each of the finishing stations is on the at least one first garniture section.

At least another example embodiment is directed toward a rod forming apparatus.

In one example embodiment, the rod forming apparatus includes the finishing section of claim 21; a feed section; an in-feed section; and a web section.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
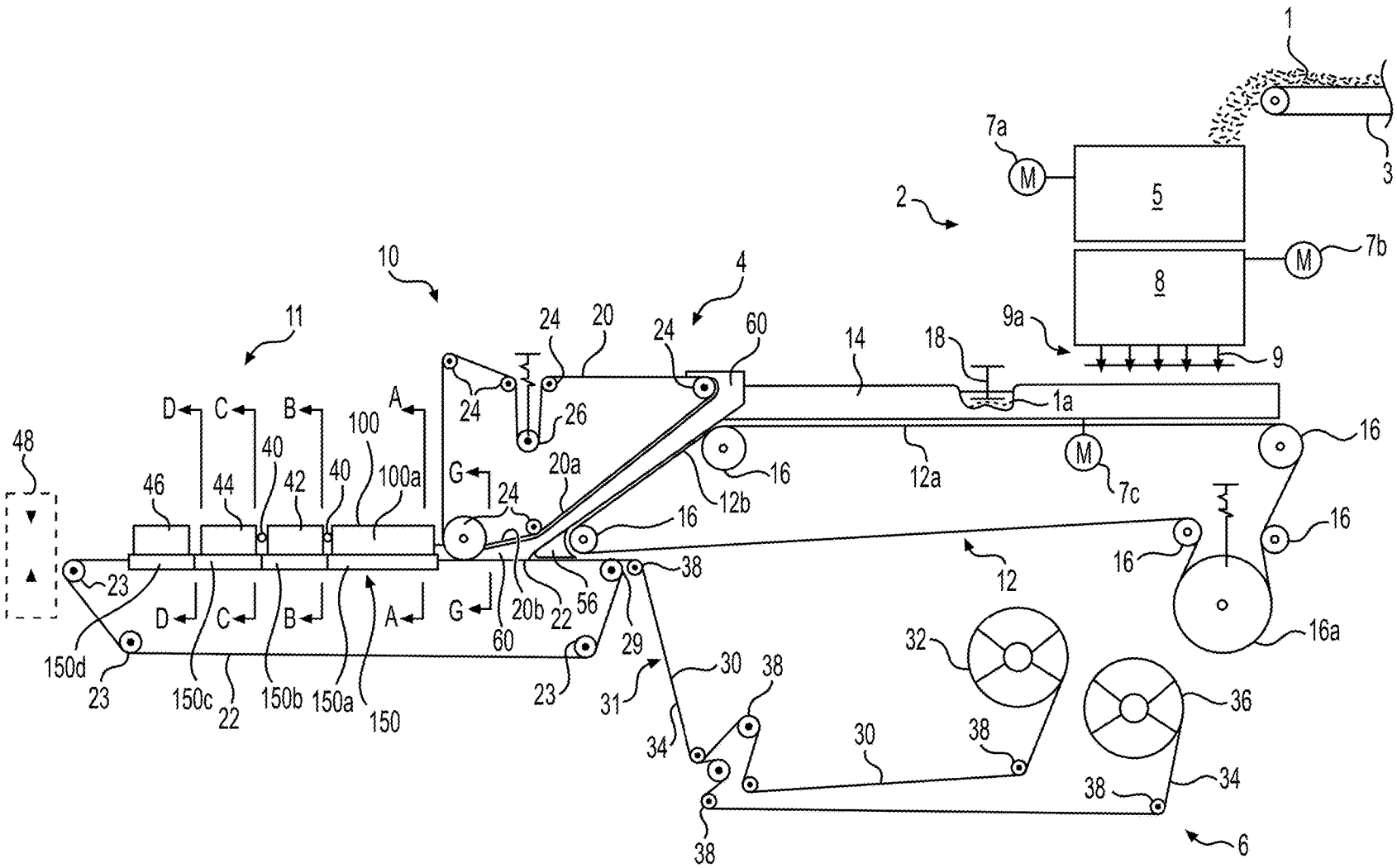
FIG. 1 is an illustration of a rod forming apparatus, in accordance with an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

When the words "about" and "substantially" are used in this specification in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

FIG. 1 is an illustration of a rod forming apparatus 10, in accordance with an example embodiment. In an example embodiment, the rod forming apparatus 10 is used for the formation of a consumer product 300 (see FIG. 10). In an example embodiment, the consumer product 300 is a rolled product. In an example embodiment, the consumer product 300 is a rolled tobacco product, such as a tobacco rod. In an example embodiment, the tobacco rod is a cigar, a cigarette, or both a cigar and a cigarette.

In an example embodiment, the rod forming apparatus 10 includes a feed section 2, an in-feed section 4, a web section 6 and a finishing section 11. In an example embodiment, the feed section 2 includes at least one conveyor 3 for receiving tobacco 1 from a tobacco source (not shown). In an example embodiment, the tobacco 1 is shredded tobacco. In an example embodiment, the feed section 2 includes a storage container 5 that may be at least one of a reservoir, a vat, a shipping container, etc. In an example embodiment, the rod forming apparatus 10 does not include a conveyor 3, as the tobacco 1 may be manually placed into the storage container 5, or the storage container 5 may be used until depleted and then replaced with another storage container 5.

In an example embodiment, the feed section 2 includes a feeder 8. The feeder 8 may be physically located below the storage container 5, and may receive tobacco 1 from the storage container 5. In an example embodiment, the feed section 2 does not include a storage container 5, and instead includes the feeder 8 and/or the conveyor 3. In an example embodiment, the storage container 5 and the feeder 8 are one integral element. Other configurations of the feed section 2 are contemplated.

In an example embodiment, the feeder 8 includes one or more outlets 9 at a lower portion of the feeder 8. In an example embodiment, the one or more outlets 9 are distributed in an outlet array 9*a*. In an example embodiment, the feeder 8 is a vibratory waterfall type feeder. In an example embodiment, the storage container 5, or the feeder 8, or both the storage container 5 and the feeder 8 include at least one electromagnetic (motorized) vibrator 7*a*/7*b* for causing the tobacco 1 to vibrate and uniformly settle, as the tobacco 1 leaves the storage container 5 and/or the feeder 8.

In an example embodiment, the feeder 8 and/or the outlets 9 are capable of distributing the tobacco 1 onto an upper (conveyor) belt 12. In an example embodiment, a first belt section 12*a* of the upper belt 12 is at least partially enclosed by a trough 14. The upper belt 12 may include rollers 16 capable of causing the upper belt 12 to move and transport the tobacco 1. In an example embodiment, the upper belt 12 includes a tensioning (biased) roller 16*a* that adjusts a tension of the upper belt 12. In an example embodiment, a trimmer unit 18 is included along the first belt section 12*a* so that a tobacco column 1*a* traveling along the first belt section 12*a* may be formed into a column with a desired and uniform height. In an example embodiment, the first belt section 12*a* includes at least one electromagnetic vibrator 7*c* to further ensure an even distribution of the tobacco column 1*a* across the first belt section 12*a*, as the tobacco column 1*a* rides along the first belt section 12*a*.

In an example embodiment, the feed section 2 and upper belt 12 provide the tobacco column 1*a* to the in-feed section 4 of the roll forming apparatus 10. In an example embodiment, the tobacco column 1*a* is transferred into the in-feed section 4 by a second belt section 12*b* of the upper belt 12 and an in-feed (compression) belt 20 that are downstream of the feeder 8. Specifically, in an example embodiment, the tobacco column 1*a* rides on the second belt section 12*b* (shown in better detail FIG. 2), while a descending belt section 20*a* of the in-feed belt 20 is in contact with a top portion of the tobacco column 1*a*. In an example embodiment, the in-feed belt 20 can be considered a compression belt, from the standpoint that the in-feed belt 20 helps assist in gently compressing the tobacco column 1*a*, as explained herein in more detail (see FIG. 2 in particular). In an example embodiment, the in-feed belt 20 travels along rollers 24. In an example embodiment, a tensioning roller 26 is included in the in-feed section 4 to adjust a tension of the in-feed belt 20.

In an example embodiment, the second belt section 12*b* and/or the descending belt section 20*a* feed the tobacco column 1*a* into the finishing section 11 of the rod forming apparatus 10. In an example embodiment, the second belt section 12*b* and/or the descending belt section 20*a* feed the tobacco column 1*a* to a lower belt 22. In an example embodiment, the lower belt 22 is a garniture belt, or a garniture tube belt. In an example embodiment, the lower belt 22 travels along a set of rollers 23.

Figure 2:
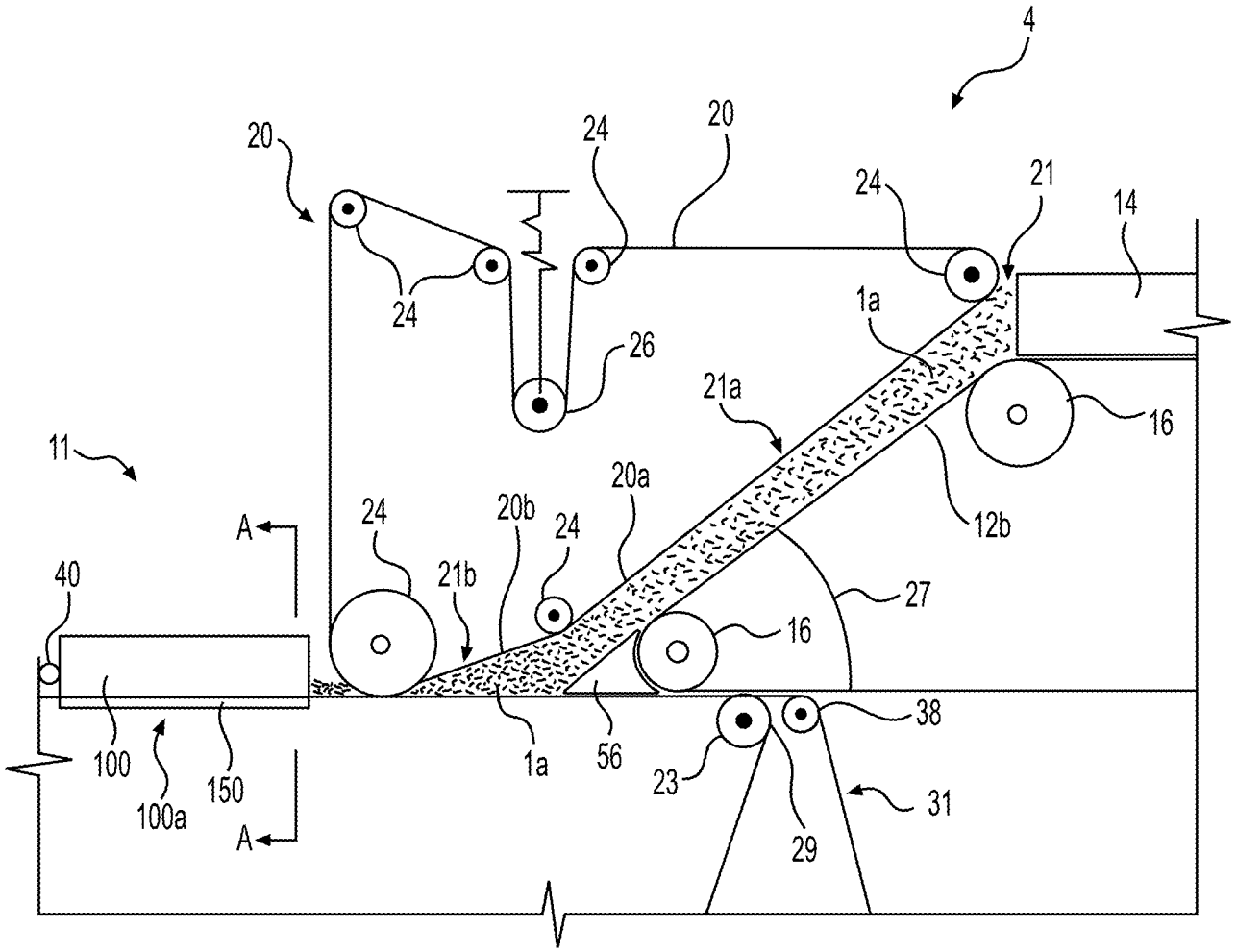
FIG. 2 is an illustration of an enlarged view of an in-feed section and a finishing section of the rod forming apparatus, in accordance with an example embodiment.

In an example embodiment, the tobacco column 1*a* enters the finishing section 11 through a channel 21 (see FIG. 2). In an example embodiment, the channel 21 has a continually and linearly decreasing vertical cross-sectional area, as described in detail in association with FIG. 2. In an example embodiment, the channel 21 is at least partially defined by a first squeeze bar 60 and a second squeeze bar 62 (see FIGS. 1 and 3), the descending belt section 20*a* of the in-feed belt 20 (see FIGS. 1 and 2), the second belt section 12*b* and the lower belt 22 (see FIGS. 1 and 2). In an example embodiment, the first squeeze bar 60 and the second squeeze bar 62 hold the tobacco column 1*a* between the descending belt section 20*a* and the second belt section 12*b* as the tobacco column 1*a* descends down to the lower belt 22, and the first squeeze bar 60 and the second squeeze bar 62 hold the tobacco column 1*a* between a horizontal belt section 20*b* of the in-feed belt 20 and the lower belt 22, as the tobacco column 1*a* is transported to a compression box 100 of the finishing section 11. In an example embodiment, the continually decreasing vertical cross-sectional area of the channel 21 forces the tobacco column 1*a* to become compressed into an ever-smaller cross-section, until the tobacco column 1*a* reaches a desired cross-sectional dimension that enters the compression box 100.

In an example embodiment, the rod forming apparatus 10 includes the web section 6, where the web section 6 provides at least one covering 31 that may be applied longitudinally around the consumer product 300. In an example embodiment, the at least one covering 31 includes at least two web layers. In an example embodiment, the at least one covering 31 includes a binder web 30 and a wrapper web 34. In an example embodiment, the binder web 30 is used to bind the tobacco 1, and in doing so, the binder web 30 may come into intimate direct contact with the tobacco 1. In an example embodiment, the wrapper web 34 is used to cover the binder web 30. In an example embodiment, a bulk portion of the binder web 30 and the wrapper web 34 are respectively housed on a binder reel 32 and a wrapper reel 36. A series of rollers 38 may be used to guide the binder web 30 and the wrapper web 34 into the finishing section 11. In an example embodiment, the binder web 30 and the wrapper web 34 are formed from tobacco, tobacco pulp, compressed tobacco, or a derivative or extract of tobacco, where the binder web 30 and the wrapper web 34 are in the form of flatten sheets or ribbons.

Figure 9A:
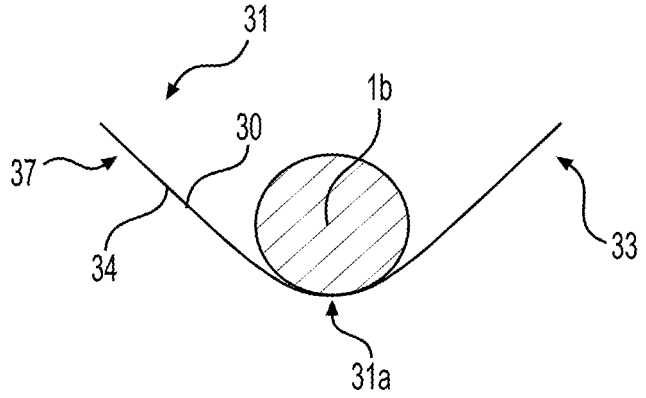
FIG. 9A is an illustration of a vertical cross-sectional view a tobacco rod being bound, in accordance with an example embodiment.

In an example embodiment, once the tobacco column 1*a* and the at least one covering 31 proceed into the finishing (rod forming) section 11, via the force of the lower belt 22, the tobacco column 1*a* is guided through the compression box 100 to form a tobacco rod 1*b* (see at least FIG. 9A, which is view A-A of FIG. 1). In an example embodiment, the compression box 100 includes a tongue assembly 100*a* (see at least FIGS. 6 and 7), that is mounted on a garniture 150 (see FIGS. 1 and 4A-4C), where the compression box 100 assists in folding the at least one covering 31 longitudinally around at least a portion of the tobacco rod 1*b* (see FIG. 9A). In an example embodiment, the tobacco rod 1*b* and the at least one covering 31 pass through the compression box 100, prior to coming into contact with an adhesive applicator 40. In an example embodiment, the adhesive applicator 40 applies an adhesive 35 to a free edge 37 of the at least one covering 31 (see FIG. 9B, which is view B-B of FIG. 1), while the at least one covering 31 is partially wrapped around the tobacco rod 1*b*, as explained in more detail herein. In an example embodiment, the adhesive applicator 40 is a glue gun, or another device capable of discharging and applying the adhesive 35 to a sheet of material such as the at least one covering 31. In an example embodiment, the adhesive 35 is a food-safe organic fixative. In an example embodiment, the adhesive 35 is made from plant extract, starch, dextrin, other food-safe adhesives, or combinations thereof.

In an example embodiment, the lower belt 22 causes the at least one covering 31 and the tobacco column 1*a* to travel in unison into and through finishing stations of the finishing section 11. In an example embodiment, the finishing stations of the finishing section 11 include the compression box 100, a short folder 42, a finishing folder 44 and a heater 46, as discussed in more detail herein (also see FIGS. 6-8). In an example embodiment, at least one folder (e.g., the short folder 42 and/or the finishing folder 44) folds the at least one covering 31 longitudinally over the tobacco rod 1*b*, as the lower belt 22 moves the tobacco into and through the finishing section 11. In an example embodiment, the other finishing stations (e.g., the compression box 100 and the heater 46) of the finishing section 11 form the tobacco rod 1*b* and/or further process the tobacco rod 1*b*, but are not involved in wrapping the tobacco rod 1*b* with the at least one covering 31. In an example embodiment, the short folder 42 folds a lap (folded) edge 33 of the at least one covering 31 toward the tobacco rod 1*b*, as shown in FIG. 9B (which is view B-B of FIG. 1). In an example embodiment, the adhesive applicator 40 can be located before or after the short folder 42, as depicted in FIG. 1. In an example embodiment, the lower belt 22 causes the at least one covering 31 and the tobacco column 1*a* to continue to travel through a finishing folder 44 and the heater 46. In an example embodiment, the short folder 42 and/or the finishing folder 44 cause the lap edge 33 of the at least one covering 31 to be pinned down on the tobacco rod 1*b*, while the free edge 37 of the at least one covering 31 is folded (in direction 39, as shown in FIG. 9C) toward the tobacco rod 1*b* and over the lap edge 33 (see FIG. 9C, which is view C-C of FIG. 1). In an example embodiment, the heater 46 applies heat to the at least one covering 31 and the tobacco rod 1*b* to set the adhesive 35. In an example embodiment, due to the heat applied by the heater 46, the at least one covering 31 is fused onto the tobacco rod 1*b* (as shown in FIG. 9D, which is view D-D of FIG. 1) to form a finished rod 41.

In an example embodiment, the garniture 150 includes sections (segments). In an example embodiment, the garniture 150 includes a first section 150*a*, a second section 150*b*, a third section 150*c* and a fourth section 150*d*. In an example embodiment, the first section 150*a* is an "entry section" of the garniture 150, the second section 150*b* and the third section 150*c* are "middle sections," and the fourth section 150*d* is an "end section" or an "exit section." In an example embodiment, the second section 150*b* and the third section 150*c* are one continuous garniture section that does not include separate smaller garniture sections. In an example embodiment, the second section 150*b*, the third section 150*c* and the fourth section 150*d* are one continuous section that does not include separate smaller garniture sections. In an example embodiment, the garniture 150 is one long continuous section that does not include separate smaller garniture sections.

In an example embodiment, the first section 150*a*, the second section 150*b* and the third section 150*c* are "first rod forming sections" of the garniture 150 of the finishing section 11, from the standpoint that the tobacco rod 1*b* flowing across these sections is being formed into a rod with a desired diameter 301 (see FIGS. 9D and 10), as the tobacco rod 1*b* passes through the compression box 100, the short folder 42 and the finishing folder 44. In an example embodiment, the second section 150*b* and the third section 150*c* are "second rod forming sections" of the garniture 150 of the finishing section 11, from the standpoint that the tobacco rod 1*b* flowing across these sections is being bound together by the at least one covering 31 (see FIGS. 9B, 9C and 9D) as the tobacco rod 1*b* flows through the short folder 42 and the finishing folder 44, so that the diameter of the tobacco rod 1*b* is formed into a rod with the desired diameter 301 (see FIGS. 9D and 10). In an example embodiment, the "second rod forming sections" of the finishing section 11 include one or more folders, such as the short folder 42 and the finishing folder 44 shown in FIG. 1.

Figure 4A:
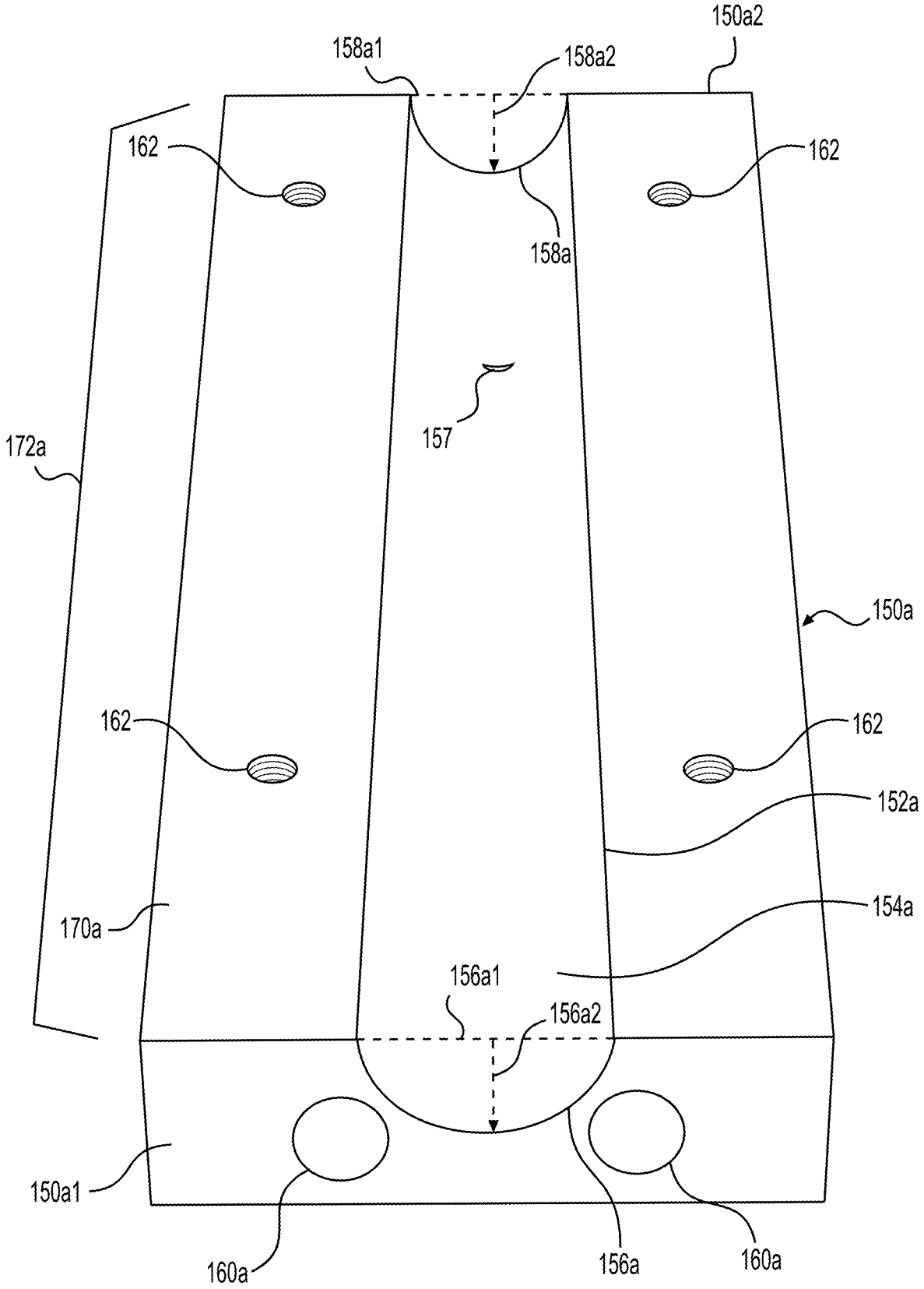
FIG. 4A is an illustration of a perspective view of a first section of a garniture of the finishing section of the rod forming apparatus, in accordance with an example embodiment.
Figure 4B:
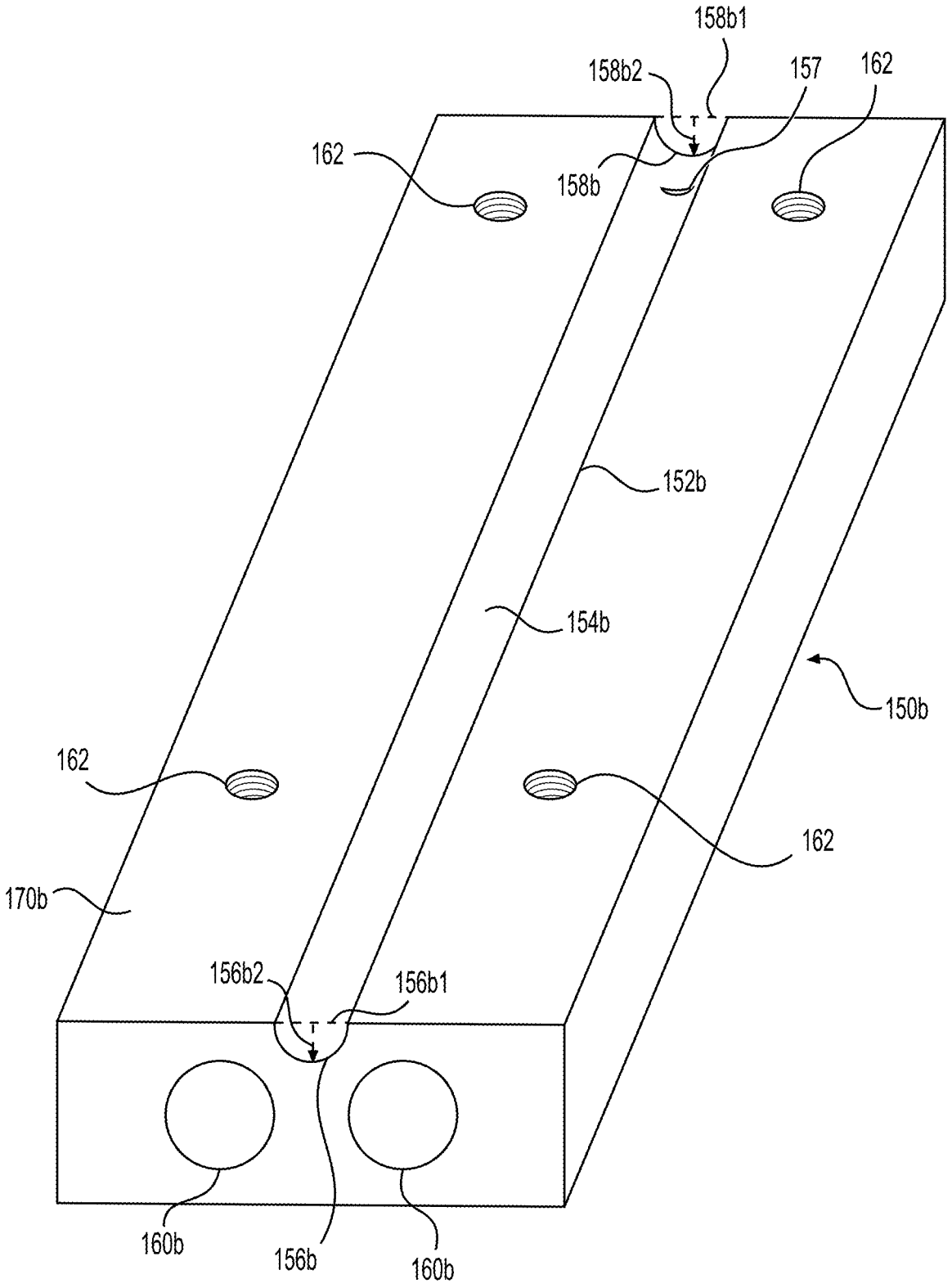
FIG. 4B is an illustration of a perspective view of a second section of a garniture of the finishing section of the rod forming apparatus, in accordance with an example embodiment.

In an example embodiment, as the tobacco rod 1*b* flows across the "first rod forming sections" and/or the "second rod forming sections" of the garniture, a size and a radius of curvature of a groove in the garniture 150 (see for example groove 152*a* and 152*b*, respectively shown in in FIGS. 4A and 4B) is particularly influential, in order to ensure that the tobacco rod 1*b* is the desired diameter 301. In an example embodiment, heat and/or friction from the at least one covering 31 and/or the lower belt 22 traveling through the finishing section 11, and across the garniture 150, can alter the dimensions of the grooves 152*a*/152*b*, which may potentially cause costly re-machining, maintenance and/or replacement of the garniture 150, as well as potentially cause downtime for the rod forming apparatus 10.

Figure 10:
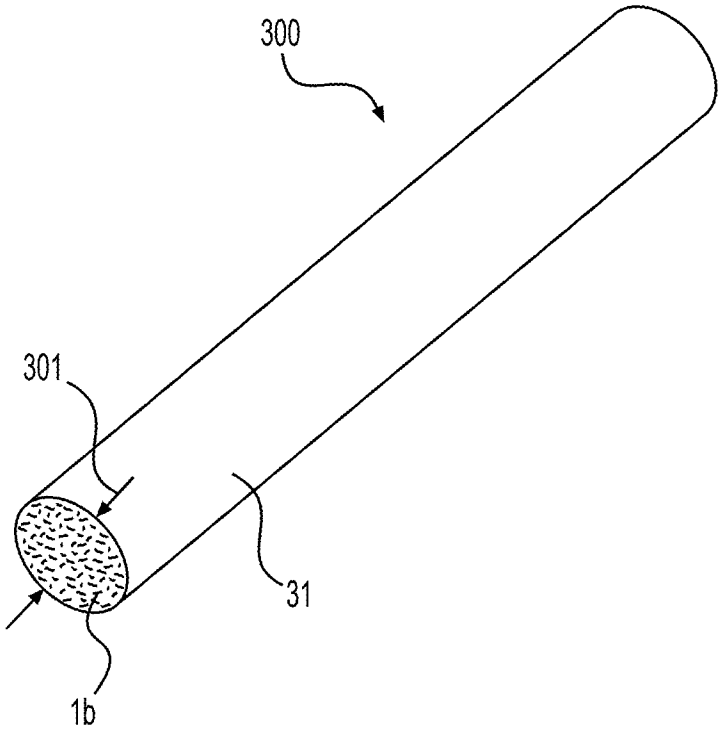
FIG. 10 is an illustration of a consumer product that is made from the rod forming apparatus, in accordance with an example embodiment.

In an example embodiment, the lower belt 22 causes the finished rod 41 to pass through a cutter 48. In an example embodiment, the cutter 48 cuts the finished rod 41 into segments, where these segments form the consumer product 300 (FIG. 10).

Figure 3:
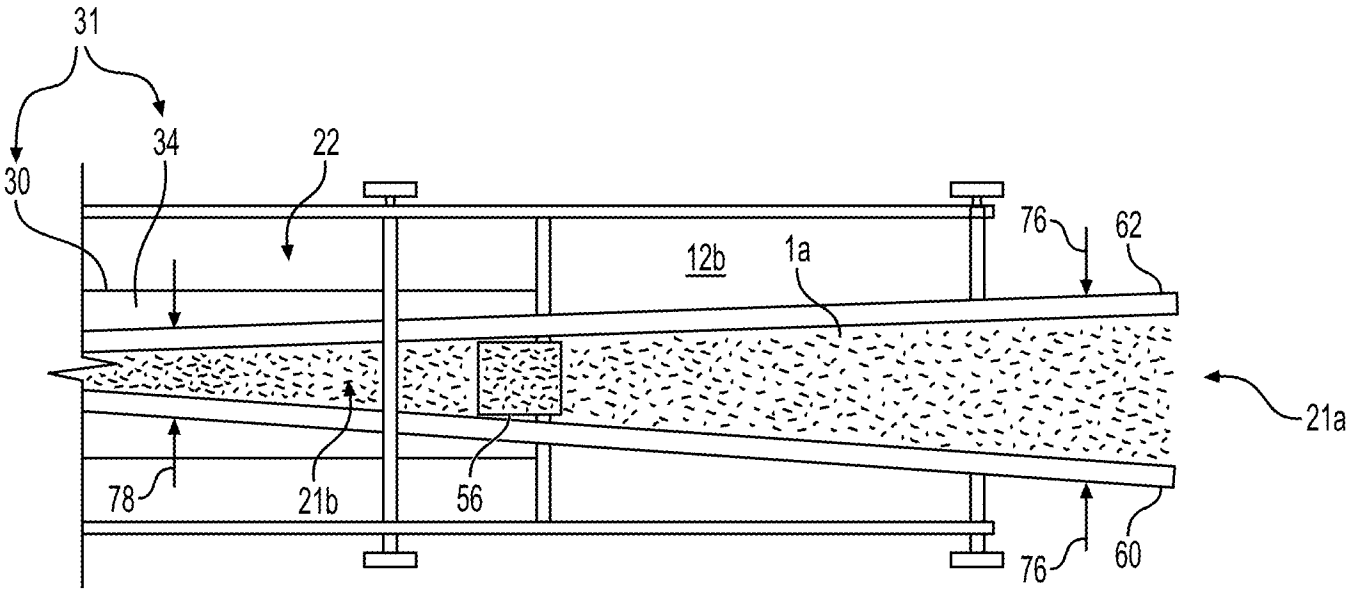
FIG. 3 is an illustration of a top view of a portion of the in-feed section, in accordance with an example embodiment.

FIG. 2 is an illustration of an enlarged view of the in-feed section 4 and a portion of the finishing section 11 of the rod forming apparatus 10 of FIG. 1, in accordance with an example embodiment. In FIG. 2, the in-feed section 4 is shown without the squeeze bar 60 in position on a side of the channel (in-feed flow path) 21, in order to better understand the in-feed section 4, though it should be understood that the squeeze bar 60 is normally installed in front of the channel 21 during normal operational use of the rod forming apparatus 10. In an example embodiment, a descending section 21*a* of the channel 21 is defined at least in part by the second belt section 12*b*, the descending belt section 20*a*, the first squeeze bar 60 and a second squeeze bar 62 (also see FIGS. 1 and 3). In an example embodiment, the tobacco column 1*a* rides primarily along the second belt section 12*b*, where the descending belt section 20*a* of the in-feed belt 20 assists in the transport of the tobacco column 1*a* through the descending section 21*a* of the channel 21. In an example embodiment, the descending section 21*a* of the channel 21 has a continually narrowing cross-sectional flow area, as the tobacco column 1*a* descends down to a horizontal section 21*b* of the channel 21, as also depicted in FIG. 3. The continually narrowing vertical cross-sectional flow area of the descending section 21*a* of the channel 21 causes the tobacco column 1*a* to be gently and continually compressed.

In an example embodiment, a decline angle 27 of the descending section 21*a* of the channel 21 (defined by the second belt section 12*b* and the descending belt section 20*a*), assists in driving the tobacco column 1*a* through the channel 21 with enough velocity that the tobacco column 1*a* has at least sufficient momentum to flow through the horizontal section 21*b* of the channel 21 and the compression box 100, where the tobacco column 1*a* is further compressed along the way.

In an example embodiment, the channel 21 is at least partially defined by the horizontal section 21*b*, where the horizontal section 21*b* feeds the tobacco column 1*a* into the compression box 100. In an example embodiment, the horizontal section 21*b* has a continually narrowing vertical cross-sectional flow area that causes the tobacco column 1*a* to be further compressed prior to flowing into the compression box 100.

In an example embodiment, the in-feed section 4 includes a transition piece 56 that further defines the channel 21. Specifically, in an example embodiment, the transition piece 56 fills a gap (bridges a transition) between the second belt section 12*b* and the lower belt 22, allowing the tobacco column 1*a* to more smoothly flow over the transition piece 56 as the tobacco column 1*a* leaves the second belt section 12*b* and flows onto the lower belt 22. In an example embodiment, the transition piece 56 may serve to reduce a level of turbulence that might otherwise be imparted to the tobacco column 1*a* traversing between the second belt section 12*b* and the lower belt 22. Specifically, in an example embodiment, the transition piece 56 occupies a space at the transition between the upper belt 12 and the lower belt 22, where this space would otherwise allow the tobacco column 1*a* to potentially accumulate and intermittently release, which may impact a consistency of the final consumer product 300.

FIG. 3 is an illustration of a top (cut-away) view of a portion of the in-feed section 4 of the rod forming apparatus 10, in accordance with an example embodiment. In this top view, a relationship is depicted between the first squeeze bar 60, the second squeeze bar 62, the second belt section 12*b* and the lower belt 22. In an example embodiment, an initial width 76 between the first squeeze bar 60 and the second squeeze bar (near a proximal end of the squeeze bars 60/62) is narrowed to a smaller width 78 (near a distal end of the squeeze bars 60/62). In an example embodiment, the squeeze bars 60/62 are positioned so that the width between the squeeze bars 60/62 is continually decreasing, just as a depth of the tobacco column 1*a* is continually decreasing (see FIG. 2). This causes the tobacco column 1*a* to gradually and continually become compressed, as the tobacco column 1*a* flows through the descending section 21*a* and the horizontal section 21*b* of the channel 21.

In an example embodiment, the at least one covering 31 comes into intimate direct contact with the tobacco column 1*a*, as the at least one covering 31 moves under and past the transition piece 56 and the tobacco column 1*a* moves over and past the transition piece 56. In an example embodiment, the lower belt 22 is directly below the at least one covering 31 (obscured from view in FIG. 3, but shown in FIG. 7), where the lower belt 22 passes under the transition piece 56.

FIG. 4A is an illustration of a perspective view of a first section 150*a* of the garniture 150 of the finishing section 11 of the rod forming apparatus 10, in accordance with an example embodiment. In an example embodiment, the first section 150*a* includes a groove 152*a* that is defined within the upper surface 170*a* of the first section 150*a*. In an example embodiment, the groove 152*a* runs along a longitudinal length 172*a* of the first section 150*a*. In an example embodiment, the groove 152*a* is defined by a surface 154*a*. In an example embodiment, the surface 154*a* is arcuate-shaped. In an example embodiment, the surface 154*a* is in the shape of a half-pipe that narrows in size and width, from an inlet 156*a* to an outlet 158*a*. In an example embodiment, a vertical cross-sectional profile of the surface 154*a* of the outlet 158*a* is in the shape of a half-circle.

In an example embodiment, the inlet 156*a* has a larger width 156*a*1 relative to a width 158*a*1 of the outlet 158*a*. In an example embodiment, the inlet 156*a* has a radius of curvature 156*a*2 that is larger than a radius of curvature 158*a*2 of the outlet 158*a*. In an example embodiment, the inlet 156*a* is larger than the outlet 158*a*, in both the width 156*a*1/158*a*1 and radius of curvature 156*a*2/158*a*2, in order to cause the tobacco rod 1*b* to become further compressed as the tobacco rod 1*b* flows through the compression box 100 (as described in more detail in FIG. 7).

In an example embodiment, the first section 150*a* includes at least one mounting hole 162. In an example embodiment, the at least one mounting hole 162 traverses through the upper surface 170*a* of the first section 150*a*. In an example embodiment, at least one mounting hole 162 is used to mount the first section 150*a* to the rod forming apparatus 10 and/or mount equipment to the upper surface 170*a* of the first section 150*a*. In an example embodiment, an interior surface of the at least one mounting hole 162 define threads. In an example embodiment, an interior surface of the at least one mounting hole 162 is smooth and does not define threads.

In an example embodiment, the first section 150*a* includes at least one cooling hole 160*a*. In an example embodiment, the at least one cooling hole 160*a* runs through the longitudinal length 172*a* of the first section 150*a* and exits near the outlet 158*a* of the groove 152*a*. In an example embodiment, the at least one cooling hole 160*a* traverses through a first end 150*a*1 and a second end 150*a*2 of the first section 150*a*. In an example embodiment, the at least one cooling hole 160*a* includes a pair of cooling holes running underneath and along (adjacent to) either side of the groove 152*a*.

In an example embodiment, the first section 150*a* includes at least one mounting hole 157 that traverses through the surface 154*a* of the groove 152*a*. In an example embodiment, the at least one mounting hole 157 is used to mount the first section 150*a* on the rod forming apparatus 10. In an example embodiment, an interior surface of the at least one mounting hole 157 defines threads. In an example embodiment, an interior surface of the at least one mounting hole 157 is smooth and does not define threads.

In an example embodiment, the other sections of the garniture 150 include cooling holes, as shown for instance in FIG. 4B (see the at least one cooling hole 160*b*). In an example embodiment, the first section 150*a* is mounted on the rod forming apparatus 10 to abut the second section 150*b* (FIG. 4B) of the garniture 150. In an example embodiment, the first section 150*a* and the second section 150*b* are mounted so that the at least one cooling hole 160*a* is in fluid communication with the at least one cooling hole 160*b* of the second section 150*b*. In an example embodiment, cooling holes, such as the at least one cooling hole 160*a*/160*b*, run through a longitudinal length of some or all of the garniture 150. In an example embodiment, cooling holes, such as the at least one cooling hole 160*a*/160*b*, run through a longitudinal length of each of the sections (150*a*, 150*b*, 150*c* and 150*d*) of the garniture 150, where the cooling holes are in fluid communication with each other.

In an example embodiment, the other sections of the garniture 150 include a groove, as shown for instance in FIG. 4B (see the groove 152*b*). In an example embodiment, the first section 150*a* is mounted on the rod forming apparatus 10 to abut the second section 150*b* (FIG. 4B) of the garniture 150, so that the outlet 158*a* of the groove 152*a* of the first section 150*a* directly abuts the groove 152*b* of the second section 150*b* (e.g., the grooves 152*a*/152*b* are in communication with each other). In an example embodiment, a groove or grooves (such as the grooves 152*a*/152*b*) run along upper surfaces of the longitudinal length of the garniture 150, such that the groove or grooves run under each of the compression box 100, the short folder 42, the finishing folder 44 and the heater 46. In an example embodiment, a groove or grooves (such as the grooves 152*a*/152*b*) run along the longitudinal length of each of the sections (150*a*, 150*b*, 150*c* and 150*d*) of the garniture 150, where each of the grooves are in communication with each other. In an example embodiment, a single groove runs along an upper surface of the longitudinal length of the garniture 150, independently of whether or not the garniture 150 is comprised of separate garniture segments (sections).

It should be understood that the at least one mounting hole 162 and the at least one mounting hole 157 can be included in some or all of the sections of the garniture 150. In an example embodiment, the first section 150*a*, or the other sections of the garniture 150, do not have the at least one mounting hole 162 and/or the at least one mounting hole 157.

In an example embodiment, the garniture 150, including each of the sections (150*a*, 150*b*, 150*c* and 150*d*) of the garniture, are made from tool steel. In an example embodiment, the garniture 150 is made from a material that is resistant to heat and erosion due to significant friction caused by the at least one covering 31 and/or the lower belt 22 running along the garniture 150. In an example embodiment, the garniture is made from a material that is not resistant to heat and erosion. In an example embodiment, an insert 420 (see at least FIG. 5C), which may overlay the garniture 150, is made from a material that is resistant to heat and erosion, as explained in detail in association with at least FIGS. 5H and 7.

FIG. 4B is an illustration of a perspective view of the second section 150*b* of the garniture 150 of the finishing section 11 of the rod forming apparatus 10, in accordance with an example embodiment. In an example embodiment, the second section 150*b* includes the groove 152*b* within the upper surface 170*b* of the second section 150*b*. In an example embodiment, the groove 152*b* is defined by a surface 154*b*. In an example embodiment, the surface 154*b* is arcuate-shaped. In an example embodiment, the surface 154*b* is in the shape of a half-pipe. In an example embodiment, a vertical cross-sectional profile of the surface 154*b* is in the shape of a half-circle.

In an example embodiment, the groove 152*b* has an inlet 156*b* and an outlet 158*b*. In an example embodiment, a width 156*b*1 and a radius of curvature 156*b*2 of the inlet 156*b* are the same as a width 158*b*1 and radius of curvature 158*b*2 of the outlet 158*b*.

In an example embodiment, the dimensions of the inlet 156*b* of the second section 150*b* match the dimensions of the outlet 158*a* of the first section 150*a*, thereby allowing the second section 150*b* to be installed on the rod forming apparatus 10 so that the second section 150*b* abuts the first section 150*a* and so that the groove 152*a* of the first section 150*a* and the groove 152*b* of the second section 150*b* are in communication with each other. In an example embodiment, when the second section 150*b* is installed on the rod forming apparatus 10, the outlet 158*a* of the first section 150*a* directly abuts the inlet 156*b* of the second section 150*b*. In an example embodiment, the width 156*b*1 of the inlet 156*b* of the second section 150*b* matches the width 158*a*1 of the outlet 158*a* of the first section 150*a*. In an example embodiment, the radius of curvature 156*b*2 of the inlet 156*b* of the second section 150*b* matches the radius of curvature 158*a*2 of the outlet 158*a* of the first section 150*a*.

In an example embodiment, the second section 150*b* includes at least one mounting hole 162 traversing through the upper surface 170*b* of the second section 150*b*. In an example embodiment, the second section 150*b* includes at least one mounting hole 157 traversing through the surface 154*b*.

Figure 4C:
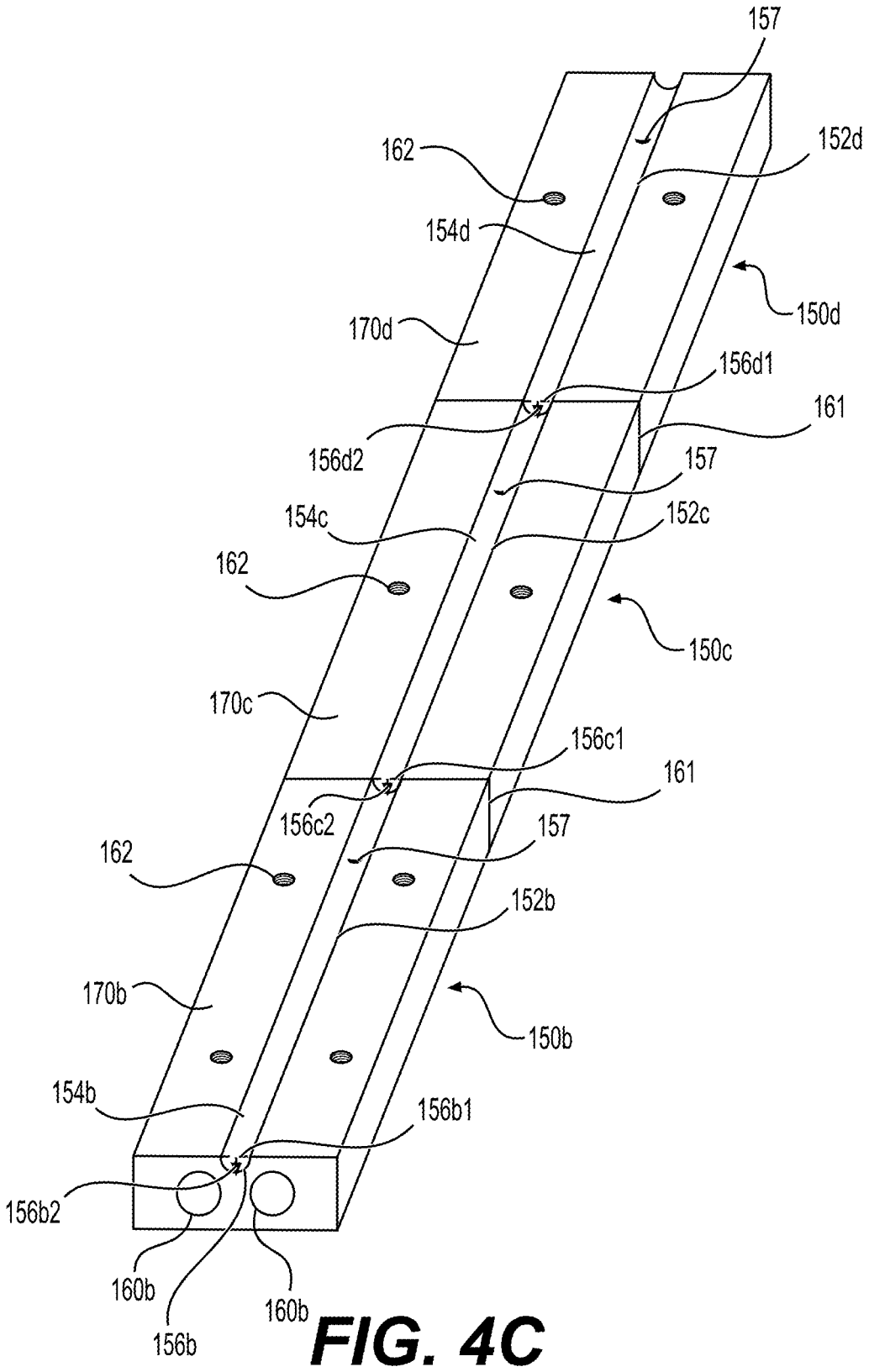
FIG. 4C is an illustration of a perspective view of a multiple sections of a garniture of the finishing section of the rod forming apparatus, in accordance with an example embodiment.

FIG. 4C is an illustration of a perspective view of multiple sections of the garniture 150 of the rod forming apparatus 10, in accordance with an example embodiment. In an example embodiment, this portion of the garniture 150 includes the second section 150*b*, the third section 150*c* and the fourth section 150*d*, each contiguously connected together. In an example embodiment, the third section 150*c* includes a groove 152*c* defined by a surface 154*c* that traverses across an upper surface 170*c* of the third section 150*c*, and the fourth section 150*d* includes a groove 152*d* defined by a surface 154*d* that traverses across an upper surface 170*d* of the fourth section 150*d*.

In an example embodiment, the third section 150*c* and the fourth section 150*d* are the same as the second section 150*b*. In an example embodiment, the second section 150*b*, the third section 150*c* and the fourth section 150*d* are identical to each other, or these sections differ only in terms of a longitudinal length.

In an example embodiment, a portion of the garniture 150 downstream of the second section 150*b* (e.g., the third section 150*c* and the fourth section 150*d*) has a groove with the same dimensions (same width 156*b*1/158*b*1 and same radius of curvature 156*b*2/158*b*2) as the groove 152*b* of the second section 150*b*. That is to say, a width 156*c*1 and radius of curvature 156*c*2 of the groove 152*c* of the third section 150*c* and a width 156*d*1 and radius of curvature 156*d*2 of the groove 152*d* of the fourth section 150*d* each are the same as the width 156*b*1 and radius of curvature 156*b*2 of the inlet 156*b* of the second section 150*b*. In an example embodiment, a remaining portion of the garniture 150 downstream of the first section 150*a* (e.g., the second section 150*b*, the third section 150*c* and the fourth section 150*d*), has a groove with a same uniform width and radius of curvature that matches the outlet 158*a* of the first section 150*a*. In an example embodiment, the remaining portion of the garniture 150 downstream of the first section 150*a* is one continuous section, or two sections only, or more than three sections.

In an example embodiment, the first section 150*a*, and the other sections (e.g., the second section 150*b*, the third section 150*c* and the fourth section 150*d*) are contiguously connected together on the rod forming apparatus to form the garniture 150, as shown in FIG. 1. In an example embodiment, the sections are connected by each section being mounted onto the rod forming apparatus 10 using the at least one mounting hole 162 and/or the at least one mounting hole 157, or by being mounted to the rod forming apparatus 10 using other structure or other means. In an example embodiment, the sections are connected by other means, such as connecting each directly to each other, through the use of screws, welding, tack-welding, indents, an adhesive, or combinations thereof. In an example embodiment, a thin spacer or gasket (not shown) can exist at a seam 161 between the sections, in order to reduce wear and avoid potential damage due to thermal growth between the sections.

In an example embodiment, once the sections of the garniture 150 are connected together, each of the grooves (e.g., grooves 152*a*, 152*b*, 152*c* and 152*d*) are aligned with each other, and therefore in communication with each other. In an example embodiment, once the sections are connected together, the at least one cooling hole (e.g., the at least one cooling hole 160*a*, 160*b*, etc.), for each section, is in communication with each other to act as a means of cooling the garniture 150. That is to say, in an example embodiment, the at least one cooling hole runs through a longitudinal length of the garniture 150 to cool the garniture 150, as the garniture is heated due to friction from the tobacco rod 1*b*, the at least one covering 31 and the lower belt 22 running along the garniture 150, as explained in more detail in FIG. 7. In an example embodiment, a cooling system supplying a cooling fluid (e.g., water) can be connected to the at least one cooling hole 160*a*/160*b*, to run the cooling fluid through the garniture 150.

In an example embodiment, once the sections of the garniture 150 are connected together, an upper surface of each section (e.g., the upper surface 170*a* of the first section 150*a*, the upper surface 170*b* of the second section 150*b*, an upper surface 170*c* of the third section 150*c*, and an upper surface 170*d* of the fourth section) are aligned to be flush with each other. That is to say, in an example embodiment, once the sections are connected to each other, the garniture 150 shares one flat upper surface. In an example embodiment, equipment, side rails 250 (see FIG. 8), and other elements can be connected to the upper surface of the garniture 150, either by using the at least one mounting hole 162, or by other means that can include clamps, bolts, cantilever structures, etc.

In an example embodiment, the garniture 150 only consists of the second section 150*b*. In an example embodiment, the garniture only consists of the second section 150*b* and the third section 150*c*. In an example embodiment, the garniture 150 only consists of the second section 150*b*, the third section 150*c* and the fourth section 150*d*. In an example embodiment, the garniture only consists of the first section 150*a*, or the first section 150*a* in conjunction with one or more of the other sections.

In an example embodiment, each of the sections of the garniture 150 is a same length. In an example embodiment, each of the sections of the garniture 150 is a different length. In an example embodiment, each section of the garniture 150 is dedicated to one element of the finishing section 11. That is to say, in an example embodiment and as shown in FIG. 1, the first section 150*a* is dedicated to the tongue assembly 100*a*, the second section 150*b* is dedicated to the short folder 42, the third section 150*c* is dedicated to the finishing folder 44 and the fourth section 150*d* is dedicated to the heater 46. In an example embodiment, more elements (stations) of the finishing section are contemplated, with a dedicated section of the garniture 150 for each of the elements, or with combinations of one or more sections of the garniture 150 being used for one or more of the elements.

Figure 5A:
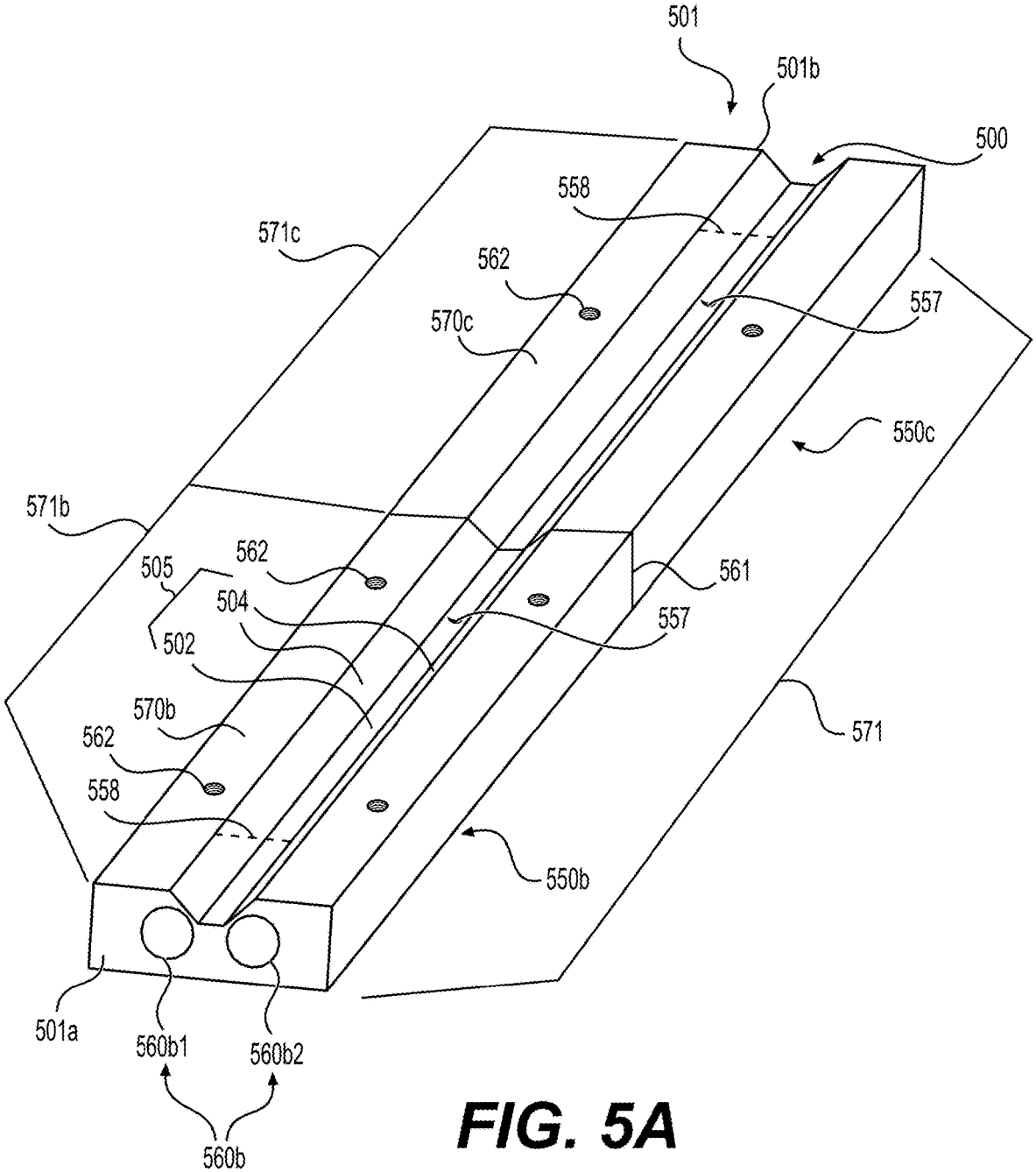
FIG. 5A is an illustration of a perspective view of a portion of a garniture, in accordance with an example embodiment.

FIG. 5A is an illustration of a perspective view of a portion 501 of a garniture, in accordance with an example embodiment. In an example embodiment, the portion 501 is part of a garniture 550 shown in FIG. 5J, or part of a garniture 551 shown in FIG. 5K. In an example embodiment, the garniture 550 or the garniture 551 includes one or more of a first section 550*a*, a second section 550*b*, a third section 550*c* and a fourth section 550*d* (see FIG. 5J or 5K), which may or may not be in combination with the first section 150*a*, the second section 150*b*, the third section 150*c* or the fourth section 150*d* of the garniture 150 (see FIGS. 4A-4C). In an example embodiment, the portion 501 includes the second section 550*b* and the third section 550*c* (as shown in FIGS. 5A and 5K).

In an example embodiment, the second section 550*b* and the third section 550*c* include a groove (channel) 500. In an example embodiment, the groove 500 includes one or more mating surfaces 505. In an example embodiment, the one or more mating surfaces 505 include a lower surface 502 and side surfaces 504. In an example embodiment, the one or more mating surfaces 505 (e.g., the lower surface 502 and the side surfaces 504) are flat surfaces. In an example embodiment, the lower surface 502 exists in a plane that is about parallel with an upper surface 570*b* of the second section 550*b* and an upper surface 570*c* of the third section 550*c*. In an example embodiment, a width 558 of the groove 500 is uniform along a longitudinal length 571 of the portion 501. In an example embodiment, the groove 500 has a uniform shape that spans the longitudinal length 571 of the portion 501. Other shapes of the groove 500 are contemplated, including grooves that are non-uniform along the longitudinal length 571 of the portion 501.

In an example embodiment, the upper surface 570*b* of the second section 550*b* is flush with the upper surface 570*c* of the third section 550*c*. In an example embodiment, the upper surface 570*b* of the second section 550*b* and the upper surface 570*c* of the third section 550*c* have one or more mounting holes 562 traversing through the surfaces, for mounting the second section 550*b* and the third section 550*c* on the rod forming apparatus 10. In an example embodiment, at least one mounting hole 557 traverses through the one or more mating surfaces 505 of the groove 500. In an example embodiment, the at least one mounting hole 557 traverses through the lower surface 502 of the groove 500, where the lower surface 502 is a flat surface that is about perpendicular with gravity, once the garniture 550 is installed on the rod forming apparatus 10.

In an example embodiment, at least one cooling hole 560*b* traverses through a longitudinal 571*b* of the second section 550*b*, under and/or adjacent to the groove 500. In an example embodiment, the at least one cooling hole 560*b* is in communication with identical cooling holes that run through a longitudinal length 571*c* of the third section 550*c*. In an example embodiment, the at least one cooling holes run through a longitudinal length 571 of the portion 501 of the garniture, and traverse through a first end 501*a* and a second end 501*b* of the portion 501. In an example embodiment, the at least one cooling hole 560*b* includes a first cooling hole 560*b*1 and a second cooling hole 560*b*2 that are symmetrically positioned adjacent to the groove 500.

In an example embodiment, a seam 561 separates the second section 550*b* from the third section 550*c*. In an example embodiment, the seam 561 includes an adhesive, a gasket, a rubber layer, a bonding material, or combinations thereof, that fill the seam 561 and assist in bonding the second section 550*b* to the third section 550*c*. In an example embodiment, no material exists within the seam 561.

In an example embodiment, the groove 500 is machined (retrofitted) into the portion 501 of the garniture 550. In an example embodiment, the second section 550*b* and the third section 550*c* are the second section 150*b* and the third section 150*c* (FIG. 4C) of the garniture 150, where the groove 152*b* of the second section 150*b* and the groove 152*c* of the third section 150*c* are machined to form the groove 500 in portion 501 (as shown in FIG. 5A). In an example embodiment, the groove 500 is machined into the portion 501 using electrical discharge machining (EDM), spark machining, spark eroding, die sinking, wire burning, wire erosion, other fabrication processes, or combinations thereof. In an example embodiment, the surfaces of the groove 500 (e.g., the lower surface 502 and the side surfaces 504) are formed to be mating surfaces that are shaped to receive the insert 420 that is overlaid onto the portion 501 of the garniture 550 to extend the life of the portion 501. As explained at least in relation to FIG. 5I, any or all of the sections (e.g., the first section 550*a*, the second section 550*b*, the third section 550*c* and the fourth section 550*d*) can include the groove 500 to allow an insert to overlay any or all of the sections of the garniture 550.

In an example embodiment, the second section 550*b* and the third section 550*c* are not machined sections, but rather the second section 550*b* and the third section 550*c* are cast and/or initially manufactured with the groove 500, where the shape of the groove 500 is formed to accept the insert 420. In an example embodiment, the one or more mating surfaces 505 of the insert 420 are formed as an "impression" of a lower end of the insert 420, where the one or more mating surfaces 505 are conformed to match with one or more mating surfaces 425 of the insert 420 (see FIG. 5D).

In an example embodiment, the groove 500 has a different shape, other than the shape shown in FIG. 5A. In an example embodiment, the groove 500 can be defined by surfaces that are flat, but are shaped differently than the lower surface 502 and the side surfaces 504. In an example embodiment, the groove 500 has a square-shaped vertical cross-sectional profile. In an example embodiment, the groove 500 has a triangular-shaped vertical cross-sectional profile (see a groove 500*a*, shown and described in FIG. 5C). In an example embodiment, the groove 500 is defined by flat surfaces (e.g., the lower surface 502 and the side surfaces 504) that allow the groove 500 to more easily mate with the insert 420, where flat surfaces are also more easy to machine and/or fabricate. In an example embodiment, the groove 500 is shaped by one or more mating surfaces that are conformed to a shape of a lower surface of the insert 420 (FIG. 5D).

In an example embodiment, other shapes of the groove 500 are contemplated. In an example embodiment, the groove 500 is defined by an arcuate-shaped surface (not shown) that is similar to the surface 154*b* of the second section 150*b* (FIG. 4B), which has a larger radius of curvature than the radius of curvature 156*b*2 of the second section 150*b*.

Figure 5B:
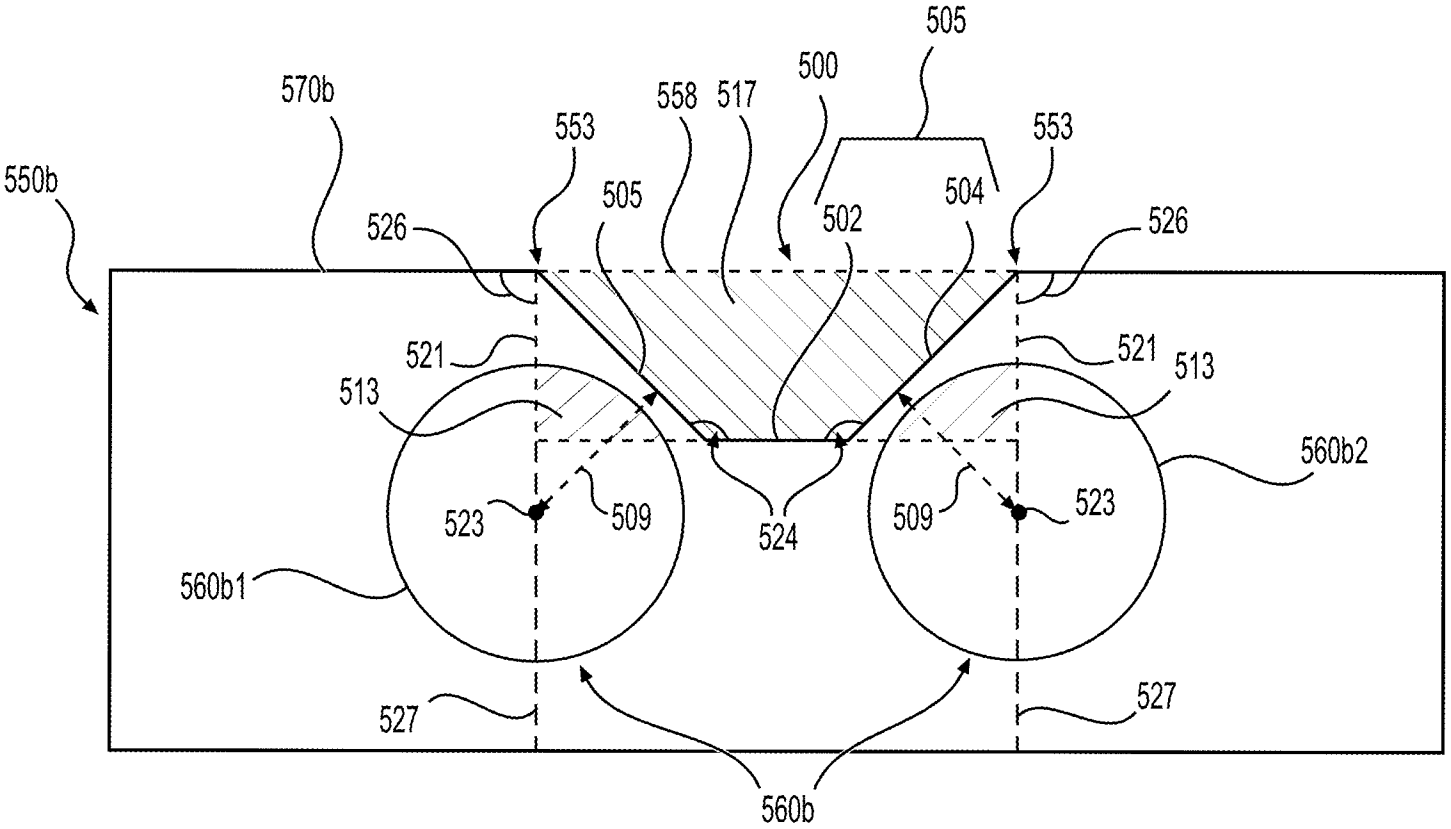
FIG. 5B is an illustration of a front view of the portion of the garniture of FIG. 5A, in accordance with an example embodiment.

FIG. 5B is an illustration of a front view of the portion 501 of the garniture 550, in accordance with an example embodiment. In an example embodiment, and as described in FIG. 5A, the groove 500 traverses through the upper surface 570*b* of the second section 550*b* and some or all of the other upper surfaces of the other sections of the garniture 550. In an example embodiment, and as described in FIG. 5A, the groove 500 includes one or more mating surfaces 505 (e.g., the lower surface 502 and the side surfaces 504) that define the groove 500. In an example embodiment, the one or more mating surfaces 505 are flat surfaces (e.g., the lower surface 502 and the side surfaces 504) that form a polygonal-shaped vertical cross-sectional profile (see vertical cross-sectional area 517), as shown in FIG. 5B. In an example embodiment, the one or more mating surfaces 505 are flat surfaces (e.g., the lower surface 502 and the side surfaces 504) that are oriented at obtuse angles (see angle 524), relative to each other. That is to say, each of the one or more mating surfaces 505 are oriented at an obtuse angle (e.g., angle 524), relative to a respective, directly adjacent mating surface. In an example embodiment, mating surfaces that are directly adjacent to the upper surface 570*b* are oriented at obtuse angles (see angle 526) relative to the upper surface 570*b*. In an example embodiment, the obtuse angles 524/526 allow for easier retrofitting and/or fabrication of the insert 420 and/or garniture 550, while ensuring tolerances between the insert 420 and garniture 550 are met. In an example embodiment, the groove 500 is defined by flat surfaces (such as the lower surface 502 and the side surfaces 504) to make the groove 500 easier to retrofit in the field, following fabrication or and/or initial installation on the rod forming apparatus 10.

In an example embodiment, other shapes for the groove 500 are contemplated. In an example embodiment, the shape of the groove 500 is arcuate-shaped, square, polygonal, triangular (see the triangular shape in FIG. 5C), etc.

In an example embodiment, the surfaces of the groove 500 (e.g., the side surfaces 504 and/or the lower surface 502) are in close proximity and/or hug the at least one cooling hole 560*b*. In an example embodiment, the at least one cooling hole 560*b* includes the first cooling hole 560*b*1 and the second cooling hole 560*b*2 (as shown in FIG. 5B), where each of the at least one cooling hole 560*b* runs along the sides surfaces 504 and the lower surface 502 and hug these surfaces. In an example embodiment, the at least one cooling hole 560*b* includes a flow of a cooling fluid (e.g., water, air, or other suitable cooling fluid) to create a cooling (temperature) gradient 509, driven by convective and conductive cooling forces, that cool the surfaces of the groove 500, and cool the insert 420 that overlays the groove 500 (see at least FIG. 5H).

In an example embodiment, the at least one cooling hole 560*b* traverses through both a width 558 and a depth 521 of the groove 500 within the second section 550*b*, in order to ensure that the at least one cooling hole 560*b* is close enough to the surfaces of the groove 500 to provide a cooling force and extend the life of the garniture 550 and the insert 420. In an example embodiment, about 10% of a total vertical cross-sectional area of the at least one cooling hole 560*b* traverses through both the width 558 and the depth 511 of the groove 500 (see area 513).

In an example embodiment, the at least one cooling hole 560*b* includes the first cooling hole 560*b*1 and the second cooling hole 560*b*2, where a center 523 of each hole is aligned below an edge 553 of the groove 500. In an example embodiment, once the second section 550*b* of the garniture 550 is installed on the rod forming apparatus 10, the center 523 of the first cooling hole 560*b*1 and the edge 553 of the groove 500 both exist along an imaginary line 527 that is plum with gravity (where the same is true of the center 523 of the second cooling hole 560*b*2).

Figure 5C:
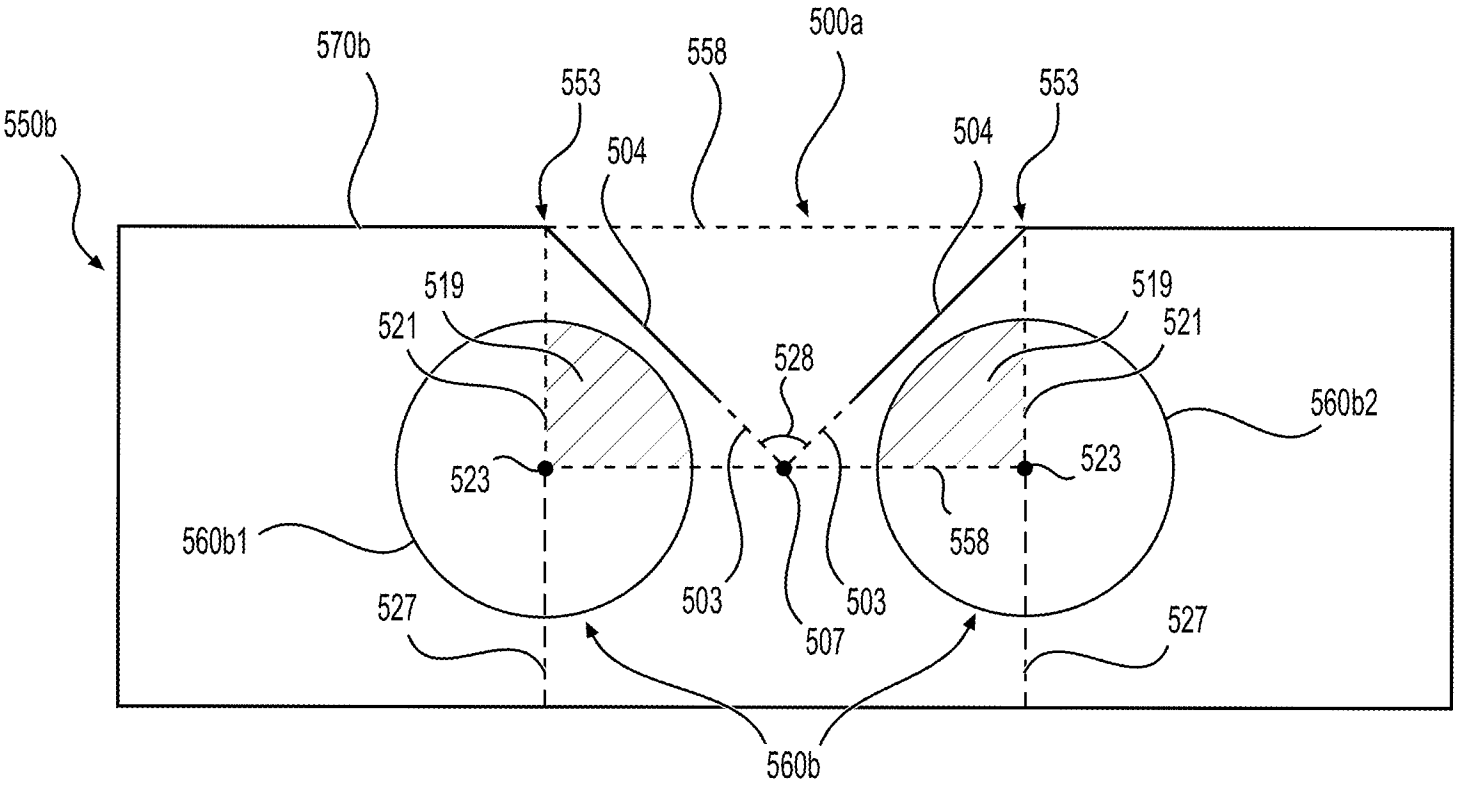
FIG. 5C is an illustration of another front view of the portion of the garniture of FIG. 5A, in accordance with an example embodiment.
Figure 5D:
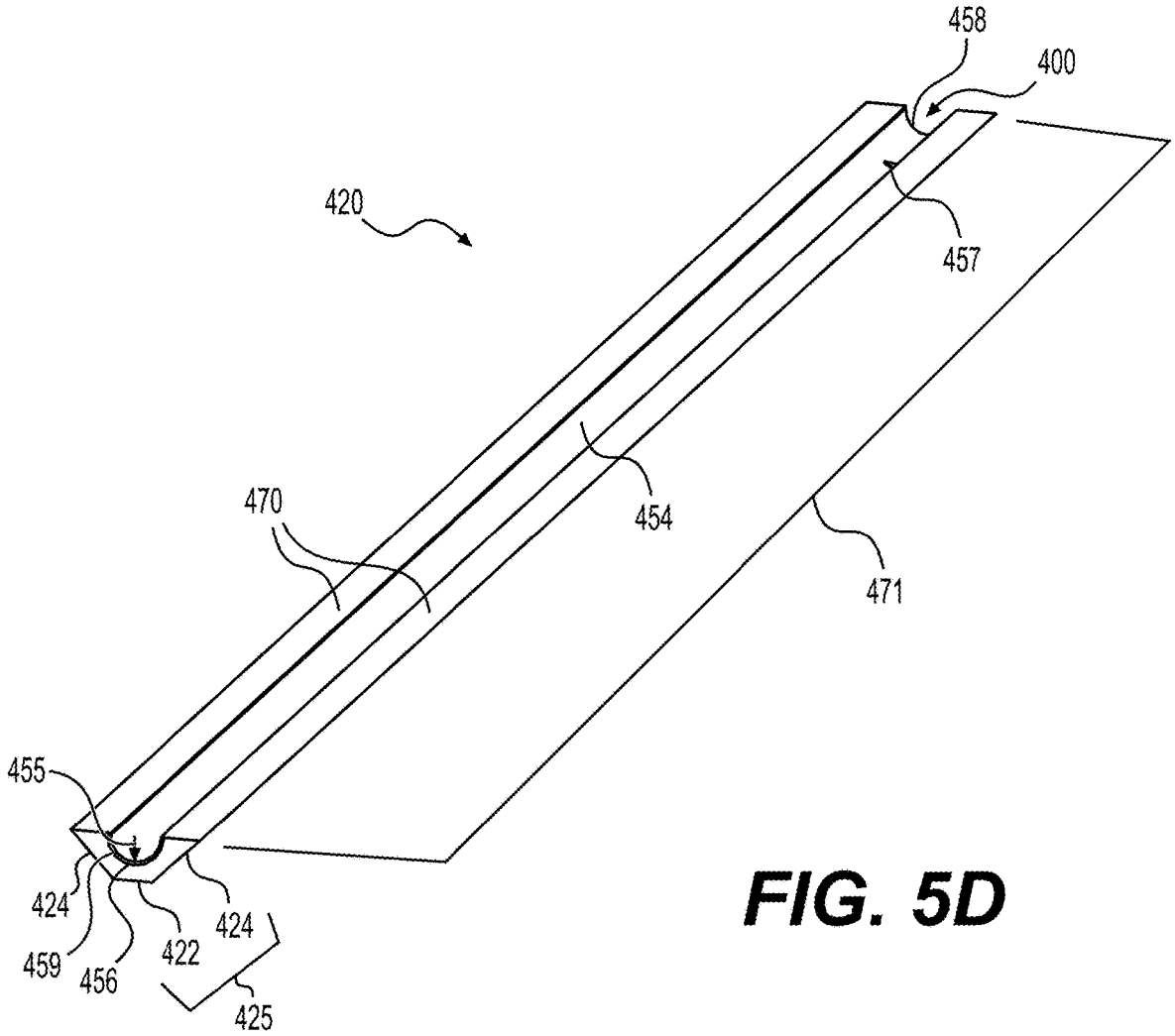
FIG. 5D is an illustration of a perspective view of an insert for a garniture, in accordance with an example embodiment.

FIG. 5C is an illustration of a front view of the portion 501 of the garniture 550, in accordance with an example embodiment. In an example embodiment, the side surfaces 504 of the groove 500*a* are extended (see extended surfaces 503), so that the side surfaces 504 meet at an apex 507, thereby giving the groove 500 a triangular-shaped vertical cross-sectional profile. In an example embodiment, about 25% of a total vertical cross-sectional area of the at least one cooling hole 560*b* traverses through both the width 558 and a depth 521 of the groove 500 (see area 519). In an example embodiment, an angle 528 between the side surfaces 504 is about 90 degrees. In an example embodiment, the angle 528 between the side surfaces 504 is an obtuse angle. In an example embodiment, the angle 528 is an acute angle.

In an example embodiment, about 5-35% of the total vertical cross-sectional area of the at least one cooling hole 560*b*, or about 10-30% of the total cross-sectional area, or about 10-25% of the total cross-sectional area, traverse through both the width 558 and the depth 511/521 of the groove 500 (see area 513/519, in FIGS. 5B and 5C).

FIG. 5D is an illustration of a perspective view of the insert 420 for the garniture 550, in accordance with an example embodiment. In an example embodiment, the insert 420 overlays the groove 500 on the portion 501 of the garniture 550. In an example embodiment, the insert 420 in sized and positioned on the rod forming apparatus 10 to endure and withstand high-erosion and high-heat services of the rod forming process to extend the life of the garniture 550. In an example embodiment, the insert 420 is designed to be replaceable over periods of time that are significantly shorter than the useful lifespan of the garniture 550.

In an example embodiment, the insert 420 includes a groove (channel) 400 that is defined by a surface 454 that traverses across a longitudinal length 471 of the insert 420.

In an example embodiment, the groove 400 has a vertical cross-sectional profile that is arcuate-shaped. In an example embodiment, the groove 400 has a vertical cross-sectional profile that is shaped as a half-pipe, or half-circle. In an example embodiment, the groove 400 has a radius of curvature 455 that matches a radius of curvature of a section of the garniture 150 that the insert 420 overlays, as explained herein. In an example embodiment, the insert 420 includes an upper surface 470 that is flat. In an example embodiment, the upper surface 470 is flush with an upper surface of the garniture 550. In an example embodiment, the upper surface 470 of the insert 420 is flush with the upper surface 570*b* of the second section 550*b* and the upper surface 570*c* of the third section 550*c* of the portion 501 of the garniture 550 (see FIG. 5H). In an example embodiment, the upper surface 470 of the insert 420 is flush with the upper surfaces 570*b*/570*c* to reduce unnecessary friction and reduce unnecessary damage to the at least one covering 31, as the lower belt 22, the tobacco column 1*a* and the at least one covering 31 travel through the finishing section 11 of the rod forming apparatus 10 (see FIGS. 1 and 7).

In an example embodiment, the surface 454 of the groove 400 is conformed to match a shape of a surface of a groove that the garniture 550 replaces. In an example embodiment, the surface 454 of the groove is conformed to the shape of the surface 154*b* of the second section 150*b* and the surface 154*c* of the third section 150*c* (FIG. 4C). In an example embodiment, the surface 454 is arcuate-shaped. In an example embodiment, the surface 454 is in the shape of a half-pipe, where a vertical cross-sectional profile of the surface 454 is in the shape of a half-circle.

In an example embodiment, the insert 420 includes the one or more mating surfaces 425. In an example embodiment, the one or more mating surfaces 425 are conformed to mate with the one or more mating surfaces 505 of the portion 501 of the garniture 550 (FIG. 5A). In an example embodiment, the one or more mating surfaces 425 span the longitudinal length 471 of the insert 420. In an example embodiment, the one or more mating surfaces 425 include a lower surface 422 and side surfaces 424. In an example embodiment, the one or more mating surfaces 425 (e.g., the lower surface 422 and the side surfaces 424) are flat surfaces. In an example embodiment, the one or more mating surfaces 425 have a triangular vertical cross-sectional shape that is conformed to the shape of the groove 500*a* (FIG. 5C). In an example embodiment, the one or more mating surfaces 425 are arcuate-shaped. In an example embodiment, other shapes of the one or more mating surfaces 425 are contemplated.

In an example embodiment, the groove 400 includes an inlet 456 and an outlet 458. In an example embodiment, the inlet 456 and the outlet 458 include a beveled edge 459 (shown in better detail in FIG. 5E).

In an example embodiment, the insert 420 can be cut or fabricated to overlay any number of the sections of the garniture 550 (see for example FIGS. 5H, 5I, 5J and 5K). In an example embodiment, the insert 420 is formed to overlay the first section 550*a*, the second section 550*b*, the third section 550*c* and the fourth section 550*d*, or just some of these sections. In an example embodiment, the insert 420 overlays more than one section of the garniture 550, where the insert 420 is one continuous insert that does not include seams along the longitudinal length 471 of the insert 420 (as shown for instance in FIGS. 5H and 5J). In an example embodiment, a separate insert 420 overlays each section of the garniture 550, where each one insert 420 is dedicated to each one section of the garniture 550.

In an example embodiment, the insert 420 is made from a same material as the garniture. In an example embodiment, the insert 420 is made from tool steel. In an example embodiment, the insert 420 is made from a material that is resistant to heat and erosion due to significant friction caused by the at least one covering 31 and/or the lower belt 22 running along the insert 420 and the garniture 550. In an example embodiment, the insert 420 is made from a material that is different than the garniture 550. In an example embodiment, the insert 420 is from a material that is more resistant to heat and erosion, as compared to the garniture 550.

In an example embodiment, the insert 420 includes at least one mounting hole 457. In an example embodiment, the at least one mounting hole 457 of the insert is aligned with the at least one mounting hole 557 in the groove 500 (FIG. 5A) to allow the insert 420 to be bolted or otherwise connected to the garniture 550. In an example embodiment, the at least one mounting hole 457 and the at least one mounting hole 557 are threaded to allow mounting bolts to be used to connect the insert 420 to the garniture 550. In an example embodiment, an opening of the at least one mounting hole 457 is countersunk to ensure a top of a mounting bolt does not protrude above the surface 454 of the groove 400.

Figure 5E:
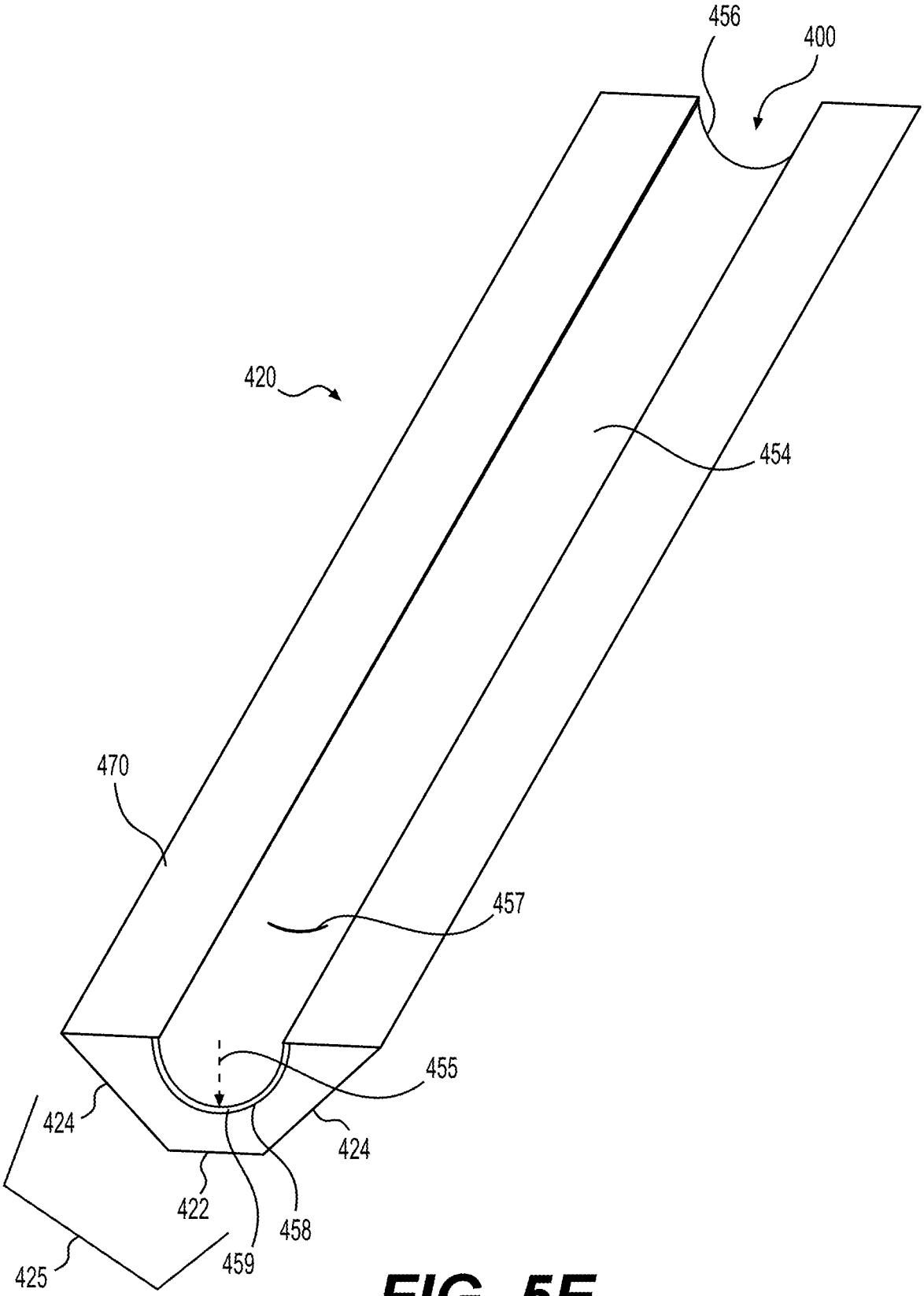
FIG. 5E is an illustration of another perspective view of the insert of FIG. 5D, in accordance with an example embodiment.

FIG. 5E is an illustration of another perspective view of the insert 420 of FIG. 5D, in accordance with an example embodiment. In an example embodiment, the inlet 456 and the outlet 458 of the groove 400 have the beveled edge 459, as shown in FIG. 5E.

Figure 5F:
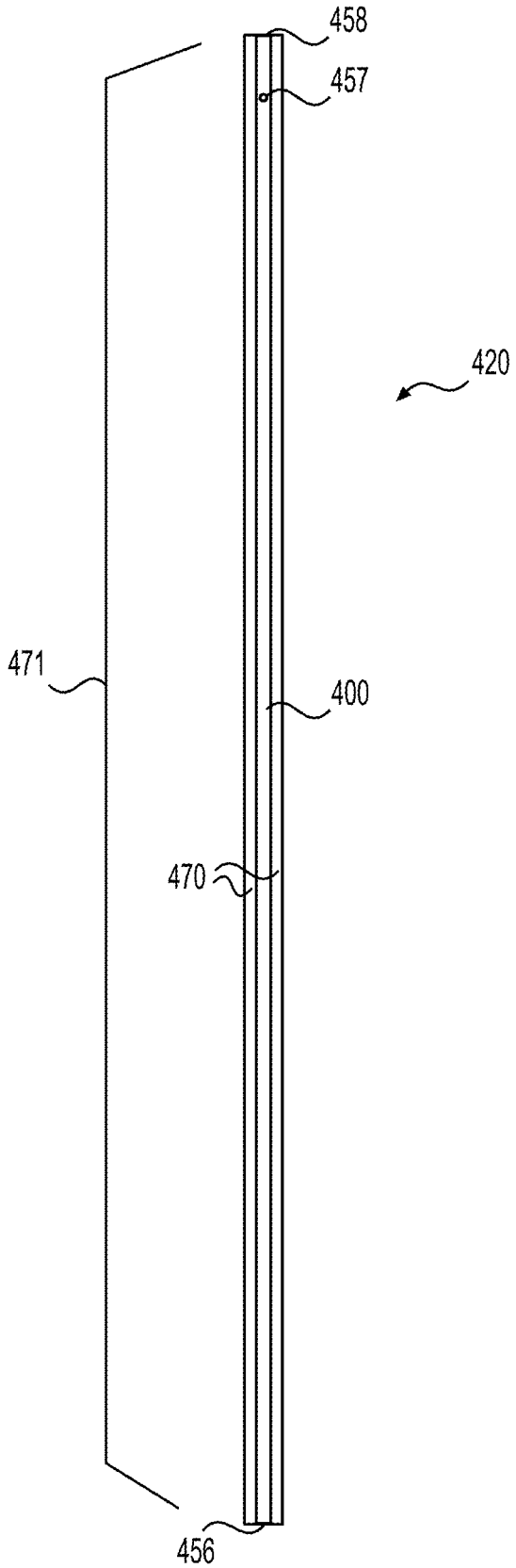
FIG. 5F is an illustration of an upper view of the insert of FIG. 5D, in accordance with an example embodiment.
Figure 5G:
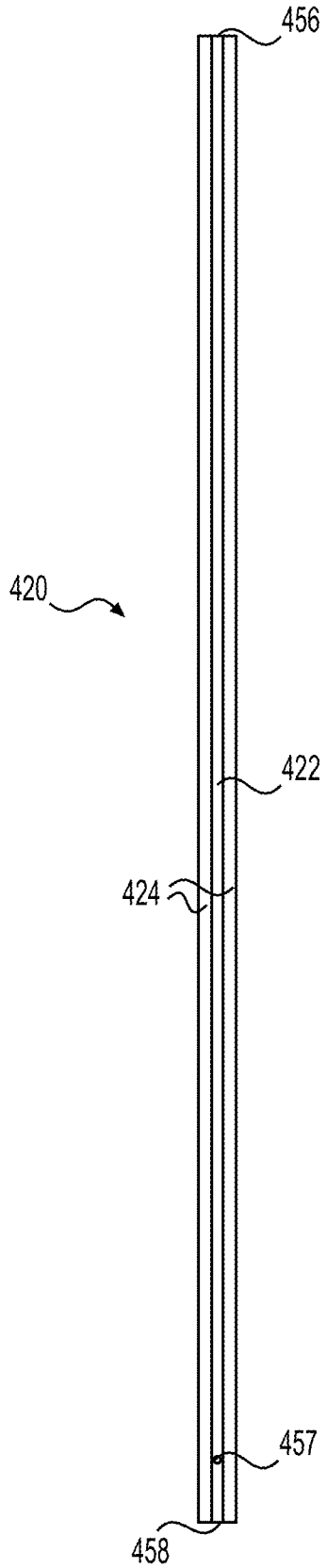
FIG. 5G is an illustration of a lower view of the insert of FIG. 5D, in accordance with an example embodiment.
Figure 5H:
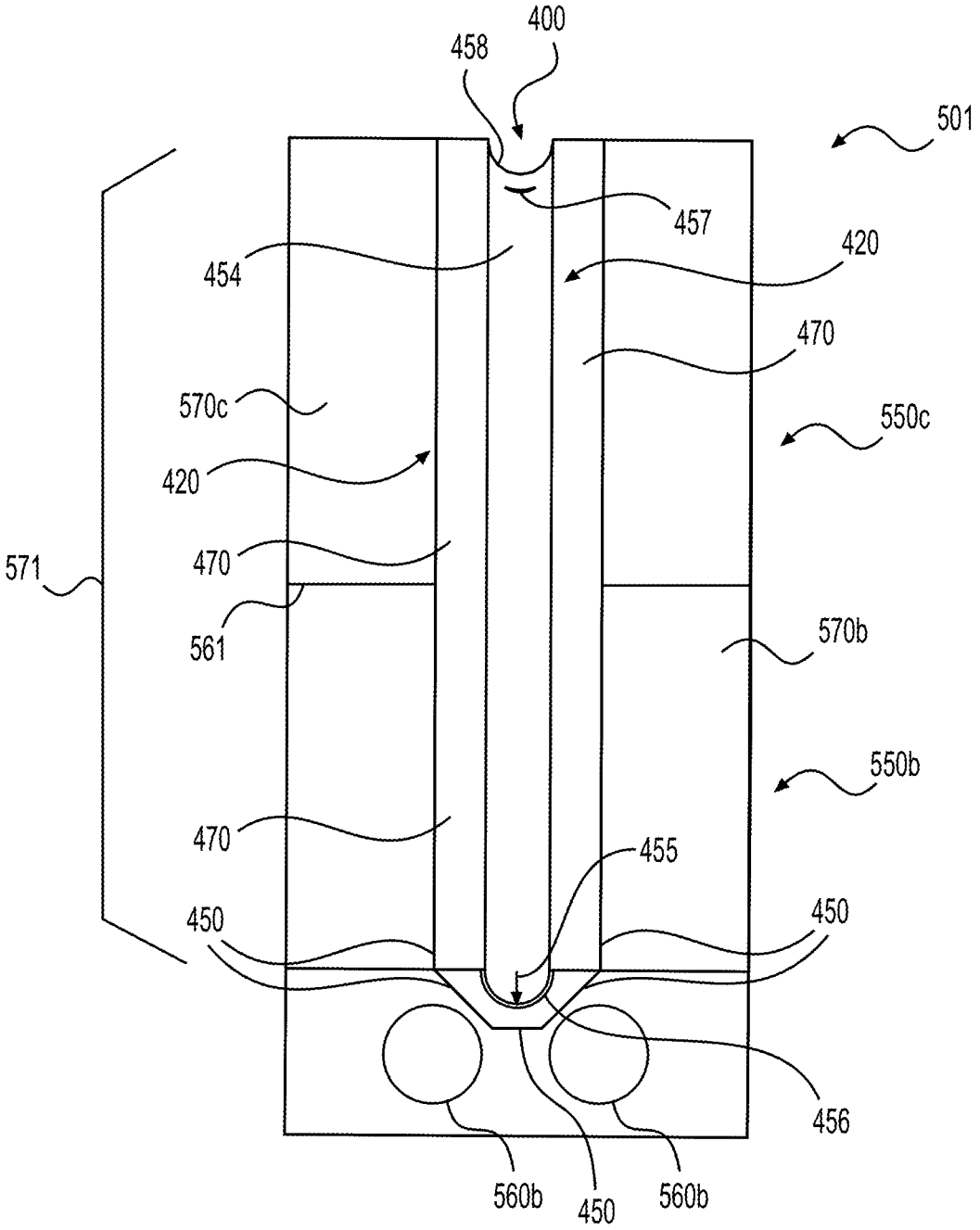
FIG. 5H is an illustration of a perspective view of the insert connected to the section of the garniture, in accordance with an example embodiment.

FIG. 5F and FIG. 5G are illustrations of an upper view and a lower view, respectively, of the insert 420 of FIG. 5D, in accordance with an example embodiment. In an example embodiment, the longitudinal length 471 of the insert 420 matches a length of the section or sections of the garniture 550 that the insert overlays. In an example embodiment, and as shown in FIG. 5H, the insert 420 overlays the second section 550*b* and the third section 550*c* of the garniture 550. In an example embodiment, insert 420 overlays only one section, or more than one section, or all of the sections of the garniture 550 (also see FIGS. 5I, 5J and 5K).

FIG. 5H is an illustration of a perspective view of the insert 420 connected to the portion 501 of the garniture 550, in accordance with an example embodiment. In an example embodiment, the insert 420 overlays the second section 550*b* and the third section 550*c* of the portion 501 of the garniture 550. In an example embodiment, the longitudinal length 471 of the insert 420 (FIG. 5D) is the same as the longitudinal length 571 of the portion 501 of the garniture 550. In an example embodiment, the portion 501 replaces the second section 150*b* and the third section 150*c* of the garniture 150 (FIG. 1). To that end, in an example embodiment, the radius of curvature 455 of the insert 420 matches the radius of curvature 156*b*2 of the second section 150*b* and the radius of curvature 156*c*2 of the third section 150*c* (FIG. 4C). In an example embodiment, the upper surface 470 of the insert 420 is flush with the upper surface 570*b* of the second section 550*b* and the upper surface 570*c* of the third section 550*c*. In an example embodiment, the insert 420 reinforces the portion 501 of the garniture 550, and extends the lifespan of the garniture 550.

In an example embodiment, the insert 420 overlays the second section 550*b* and the third section 550*c* of the garniture 550 (corresponding to the second section 150*b* and the third section 150*c* of the garniture 150 of FIG. 1), as these are the two "second rod forming sections" where the tobacco rod 1*b* is compressed and bound by the at least one covering 31 to form the consumer product 300 with the desired diameter 301 (see the tobacco rod 1*b* compression occurring in FIGS. 9B and 9C, where the tobacco rod 1*b* is at the desired diameter 301 in FIGS. 9D and 10). In these "second rod forming sections," any wearing or erosion of the groove 400, which even minutely distorts the radius of curvature 455 of the groove 400, will also undesirably distort a diameter of the consumer product 300 so that the diameter deviates from the desired diameter 301 (FIG. 10). In an example embodiment, the insert 420 overlays the first section 550*a*, the second section 550*b* and the third section 550*c*, as these sections are the "first rod forming sections" where the tobacco column 1*a* is compressed into the tobacco rod 1*b*, and the tobacco rod 1*b* is bound using the at least one covering 31.

In an example embodiment, the one or more mating surfaces 505 of the portion 501 of the garniture (FIG. 5A) mate with the one or more mating surfaces 425 on a lower surface of the insert 420 (FIG. 5D). In an example embodiment, the one or more mating surfaces 505 mate and are flush with the one or more surfaces 425, such that no gaps exist between the surfaces, or within a seam 450, between the portion 501 of the garniture 550 and the insert 420. In an example embodiment, by ensuring that no gaps exist between the surfaces of the insert 420 and the portion 501 of the garniture 550, heat is more effectively dissipated from the insert 420, via a conductive cooling force created by the cooling gradient 509 (FIG. 5B).

In an example embodiment, no materials exist in the seam 450 between the insert 420 and the portion 501 of the garniture 550. In an example embodiment, an adhesive material is included in the seam 450. In an example embodiment, an adhesive material is used, in lieu of or in addition to bolting the insert 420 to the portion 501 of the garniture 550.

Figure 5I:
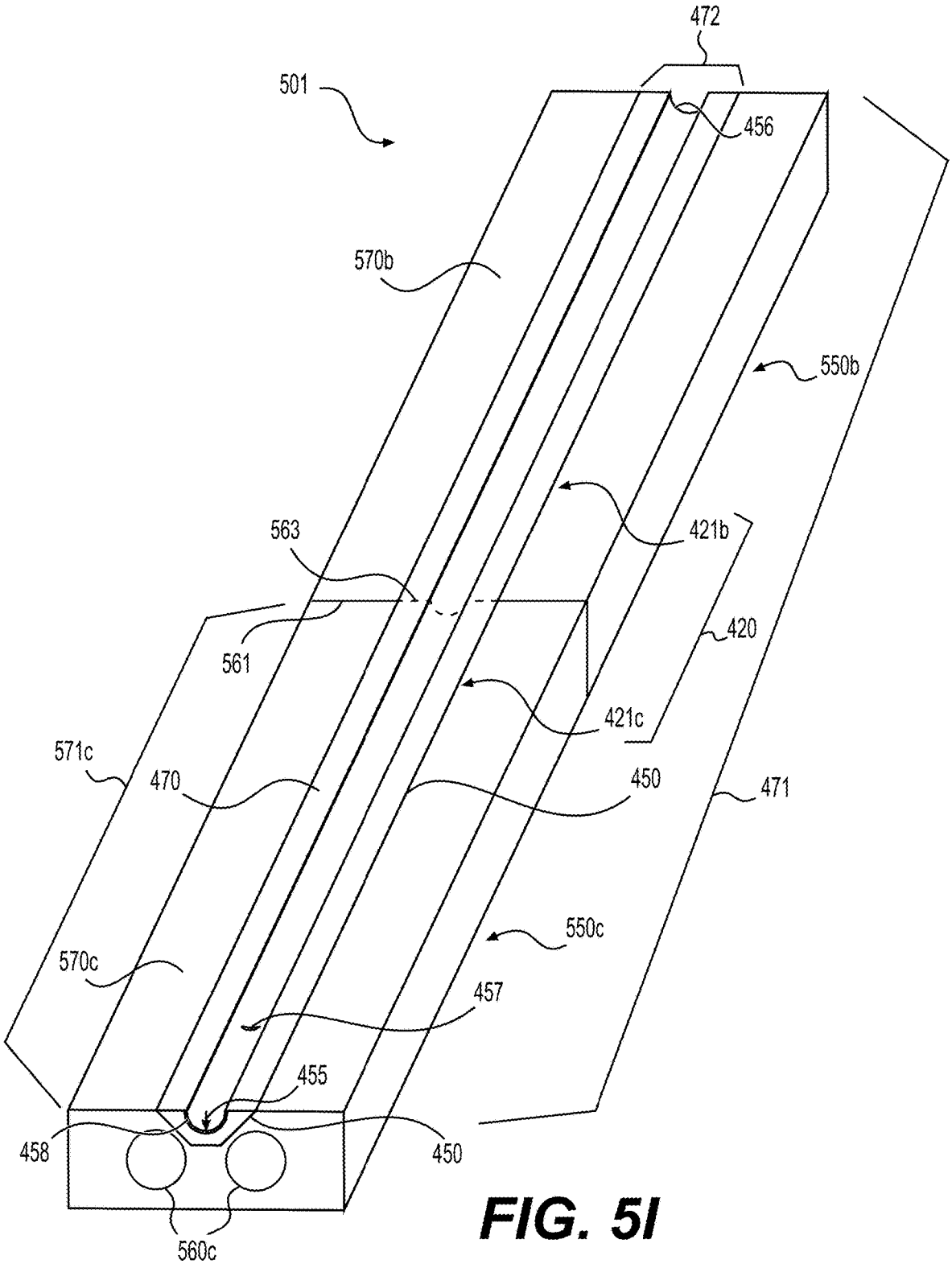
FIG. 5I is an illustration of another perspective view of the insert and garniture of FIG. 5H, in accordance with an example embodiment.

FIG. 5I is an illustration of another perspective view of the insert 420 and the portion 501 of the garniture of FIG. 5H, in accordance with an example embodiment. In an example embodiment, the insert 420 is one continuous insert that does not include a seam along the longitudinal length 471 of the insert 420. In an example embodiment, a seam 563 exists in the insert 420, such that the insert 420 is formed of two separate sections (e.g., an insert section 421*b* overlaying the second section 550*b*, and an insert section 421*c* overlaying the third section 420*c*). In an example embodiment, a width 472 of the insert 420 is wide enough to prevent the at least one covering 31 and the lower belt 22 from contacting the upper surface 570*b* of the second section 550*b* and the upper surface 570*c* of the third section 550*c*, as described in relation to FIG. 7.

In an example embodiment, and as described above, at least one cooling hole 560*c* of the third section 550*c* runs through a longitudinal length 571*c* of the third section 550*c*, and is in fluid communication with the at least one cooling hole 560*b* of the second section 550*b* (see FIG. 5H).

Figure 5J:
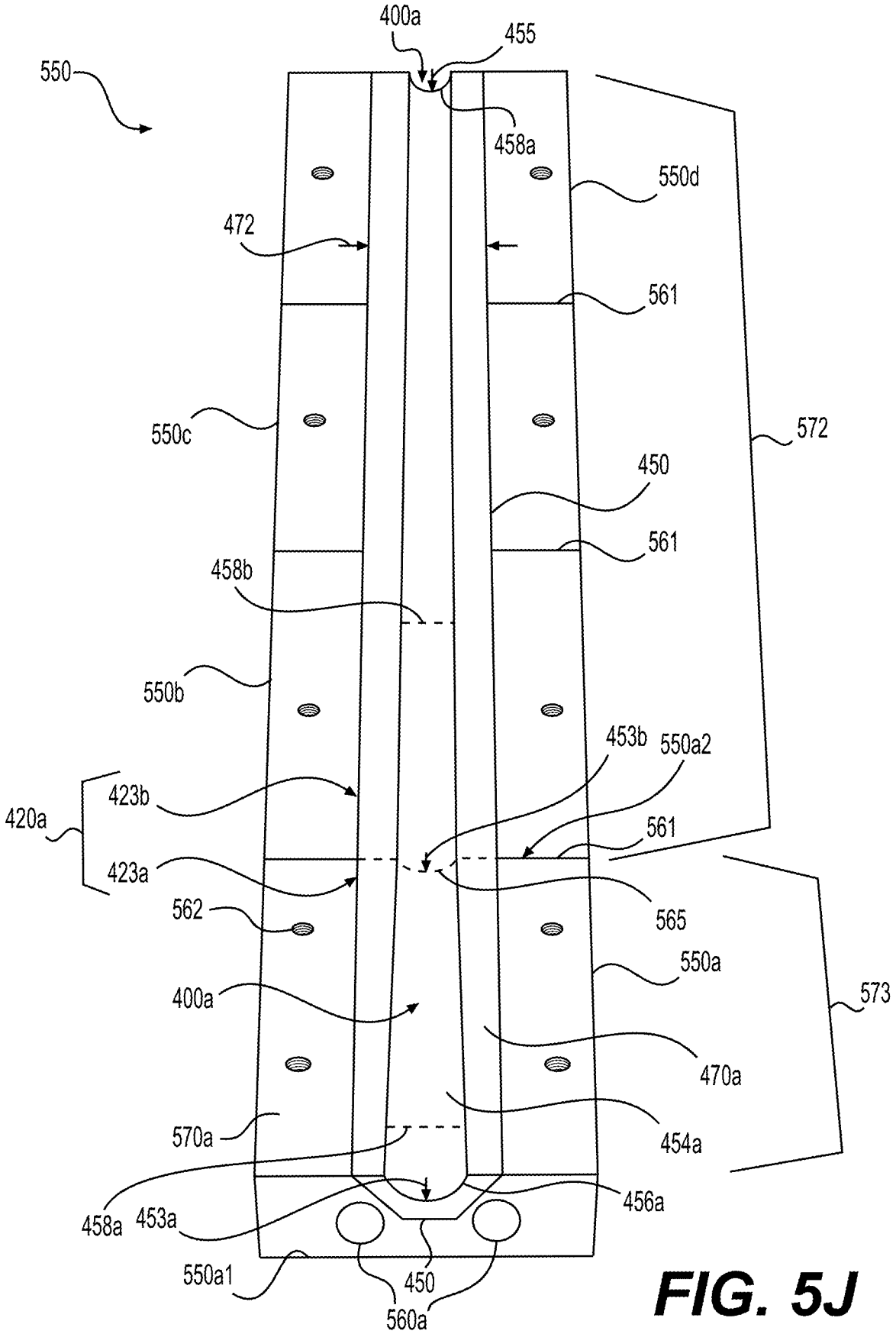
FIG. 5J is an illustration of a perspective view of an insert connected to a garniture, in accordance with an example embodiment.
Figure 5K:
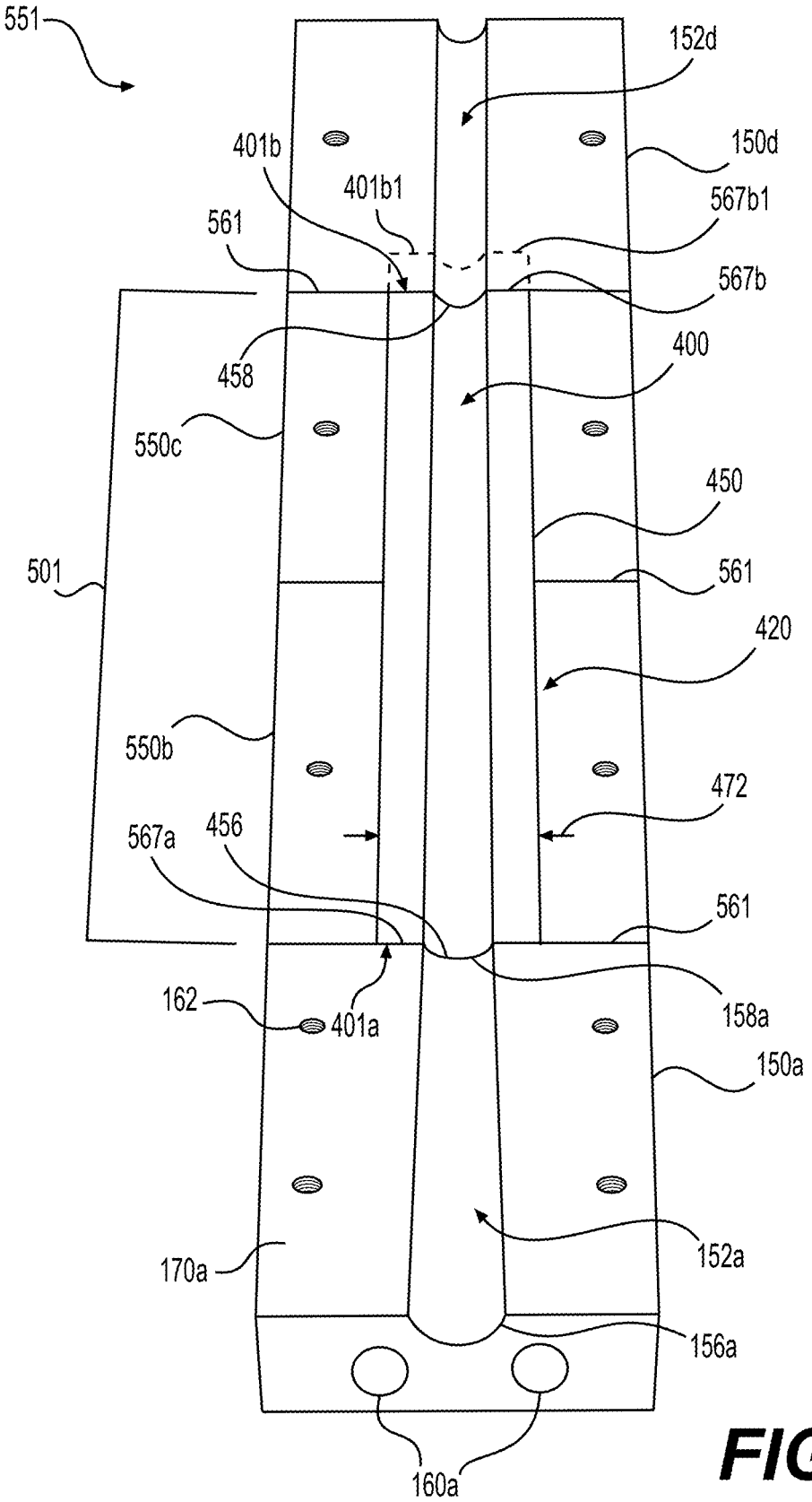
FIG. 5K is an illustration of a perspective view of an insert connected to a portion of a garniture, in accordance with an example embodiment.

FIG. 5J is an illustration of a perspective view of an insert 420*a* connected to the garniture 550, in accordance with an example embodiment. In an example embodiment, the first section 550*a*, the second section 550*b*, the third section 550*c* and the fourth section 550*d* are contiguously connected together to form the garniture 550. In an example embodiment, the insert 420*a* overlays one or more of the sections of the garniture 550. In an example embodiment, the insert 420*a* includes a first insert portion 423*a* and a second insert portion 423*b* that are separated by a seam 565. In an example embodiment, the second insert portion 423*b* is identical to the insert 420 of FIG. 5D, other than a length of the second insert portion 423*b* which spans a longitudinal length 572 of the second section 550*b*, the third section 550*c* and the fourth section 550*d* of the garniture 550. In an example embodiment, the first insert portion 423*a* has an upper surface 470*a* that is flush with the upper surface 570*a* of the first section 550*a*. In an example embodiment, the seam 565 does not exist, and the insert 420*a* spans a full length of the garniture 550, including spanning across the first section 550*a*.

In an example embodiment, and as discussed in more detail in FIG. 5K, the insert 420*a* can overlay any combination of the sections (e.g., the first section 550*a*, the second section 550*b*, the third section 550*c* and the fourth section 550*d*) of the garniture 550. In an example embodiment, the insert 420*a* does not terminate at an end of one or more of the sections of the garniture 550. That is to say, the insert 420*a* does not need to be dedicated to overlay an entirety of one or more of the sections of the garniture 550, but instead an end 401*b*1 of the insert 420*a* can extend and overlay only part of one of the sections of the garniture 550. For example, in an example embodiment, the end 401*b*1 of the insert 420*a* can extend onto the fourth section 150*d*, as shown depicted by seam 567*b*1, in FIG. 5K. In this embodiment, the groove 500 (FIG. 5A) can be extended into the fourth section 150*d*, so the end 401*b*1 of the insert 420 can overlay a portion of the fourth section 150*d*. In an example embodiment, a width 472 of the insert 420*a* is wide enough to prevent the at least one covering 31 and the lower belt 22 from contacting upper surfaces of the garniture 550, as described in relation to FIG. 7.

In an example embodiment, the first insert portion 423*a* and the second insert portion 423*b* have the one or more mating surfaces 425 (FIGS. 5D and 5E) that mate with the one or more mating surfaces 505 in the groove 500 of the garniture 550 (see FIGS. 5A and 5B). In an example embodiment, the radius of curvature 455 is uniform along the second insert portion 423*b*, where the radius of curvature 455 matches the radius of curvature (156*b*2, 156*c*2, 156*d*2) of the second section 150*b*, the third section 150*c* and the fourth section 150*d* of the garniture 150 (see FIGS. 1, 4B and 4C). In an example embodiment, a surface 454*a* defines a groove 400*a* along a longitudinal length 573 of the first section 550*a*. In an example embodiment, a radius of curvature 453*a* of an inlet 456*a* of the groove 400*a*, and a radius of curvature 453*b* of an outlet 456*b* of the groove 400*a*, match the respective radius of curvature 156*a*2 of the inlet 156*a* and the radius of curvature 158*a*2 of the outlet 158*a* of the first section 150*a* of the garniture 150 (see FIG. 4A).

In an example embodiment, the first section 550*a* of the garniture 550 is a "leading" section of the garniture 550, from the standpoint that the first section 550*a* is the first (leading) section of the finishing section 11 of the rod forming apparatus 10. In an example embodiment, a width 458*a* of the groove 400*a* narrows (tapers), from a first end 550*a*1 to a second end 550*a*2 of the first section 550*a*. In an example embodiment, the first section 550*a* supports the compression box 100 of the finishing section 11 (see FIG. 1). In an example embodiment, a width 458*b* of the groove 400*a* is constant along the longitudinal length 572 of the remaining portion of the insert 420*a* that is connected to the second section 550*b*, the third section 550*c* and the fourth section 550*d*.

In an example embodiment, other shapes and widths of the groove 400*a* are contemplated, depending on characteristics of the finishing section 11, and depending on desired dimensions for the consumer product 300 (FIG. 10). In an example embodiment, a width of the groove 400*a* varies along an entire length of the garniture 550.

FIG. 5K is an illustration of a perspective view of the insert 420 connected to the portion 501 of a garniture 551, in accordance with an example embodiment. In an example embodiment, the insert 420 overlays the second section 550*b* and the third section 550*c* of the portion 501 (see FIG. 5A). In an example embodiment, the first section 150*a* and the fourth section 150*d* of the garniture 150 (FIGS. 1 and 4A) are contiguously connected to ends of the portion 501 to form the garniture 551.

In an example embodiment, a first end 401*a* and a second end 401*b* of the insert 420 each terminate at an edge of the first section 150*a* and the fourth section 150*d*, so that a first seam 567*a* and a second seam 567*b* each are aligned with the seams 561 that are between the sections of the garniture 551 at these locations. In an example embodiment, one or both of the ends of the insert 420 can terminate at a location other than at the ends of the sections of the garniture 551. In an example embodiment, the end 401*b*1 of the insert 420 can be extended to overlay part of the fourth section 150*d* (see seam 567*b*1).

In an example embodiment, once the first section 150*a* is contiguously connected to the second section 550*b*, the third section 550*c* and the fourth section 150*d*, the groove 152*a* is aligned and in communication with the groove 400 of the insert 420 and the groove 152*d* of the fourth section 150*d*, as shown in FIG. 5K.

Figure 6:
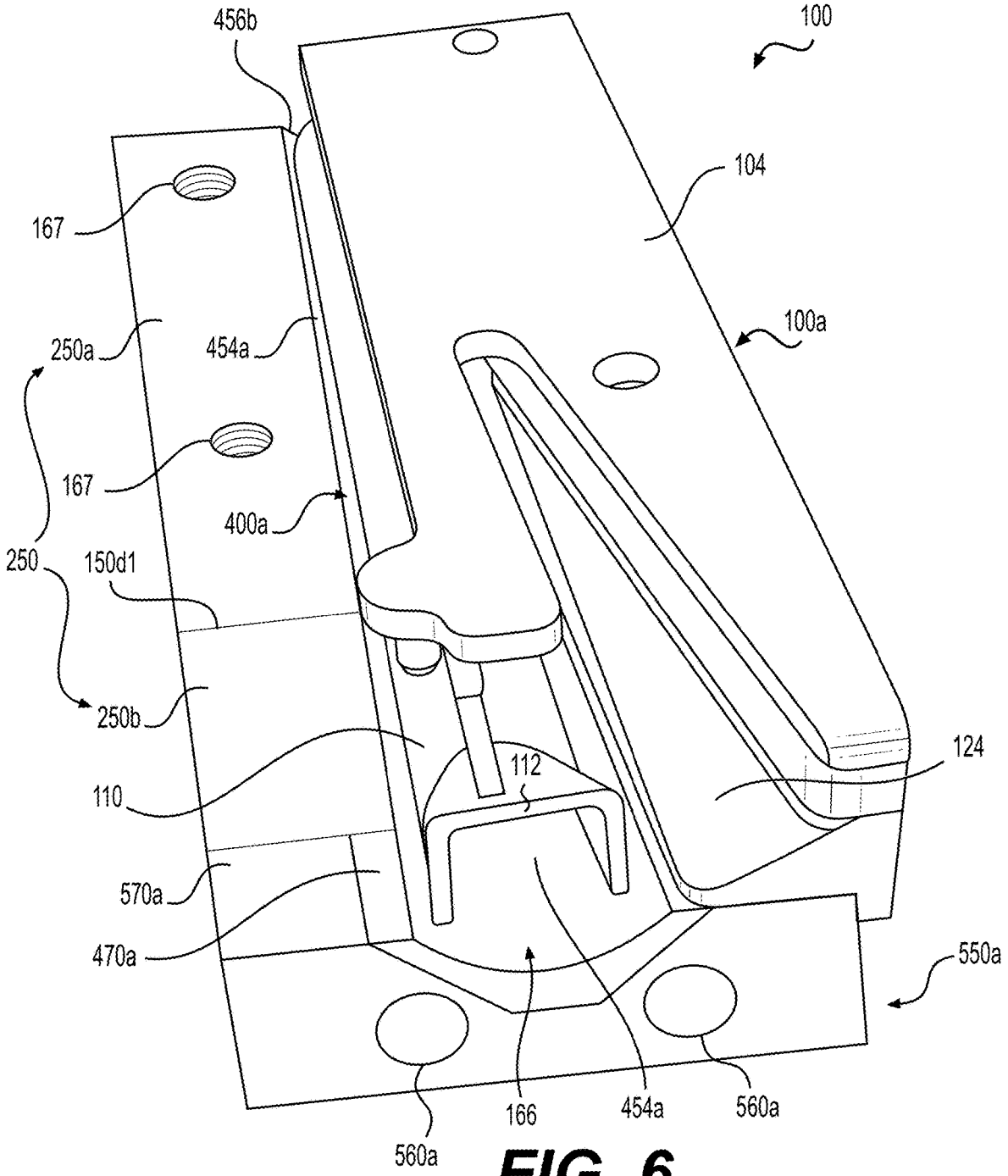
FIG. 6 is an illustration of a perspective view of a compression box of the rod forming apparatus, with the garniture and insert, in accordance with an example embodiment.

FIG. 6 is an illustration of a perspective view of the compression box 100 of the rod forming apparatus 10, in accordance with an example embodiment. The compression box 100 includes the first section 550*a* of the garniture 550 (see FIG. 5J), where the tongue assembly 100*a* is mounted on the first section 550*a*. In an example embodiment, the compression box 100 can include the first section 150*a* of the garniture 150 (FIG. 5K), rather than the first section 550*a*.

In an example embodiment, the compression box includes the side rail 250 connected to the upper surface 570*a* of the first section 550*a*. In an example embodiment, the side rail 250 include a flat portion 250*a* and a sloped portion 250*b* that help ease a free edge 37 of the at least one covering 31 into a vertical position as the at least one covering 31 passes through the compression box 100 (see the difference in the position of the free edge 37, between FIG. 9A and FIG. 9B). In an example embodiment, the side rail 250 includes mounting holes 167 that are aligned with one or more mounting holes 562 in the upper surface 570*a* of the first section 550*a* (see FIG. 5J).

In an example embodiment, the tongue assembly 100*a* includes a mounting plate 104 that holds and aligns a shaft 110 along the surface 454*a* of the groove 400*a* to form a channel 166. In an example embodiment, and entrance 112 to the shaft 110 initially receives the tobacco column 1*a* (see FIG. 7), and as the tobacco column 1*a* flows through the entrance, the tobacco column 1*a* is compressed into the tobacco rod 1*b*, where the tobacco rod 1*b* becomes further compressed as it passes through the compression box 100 (see FIG. 9A, which is view A-A of FIG. 1, where the tobacco rod 1*b* has been shaped into a cylinder after passing through the entrance 112).

In an example embodiment, the tongue assembly 100*a* includes an inclined surface 124 that causes a lap edge 33 of the at least one covering 31 to be gradually folded over as the at least one covering 31 passes through the compression box 100 (see the difference in the lap edge 33 position, between FIGS. 9A and 9B, which correspond with view A-A and B-B of FIG. 1).

Figure 7:
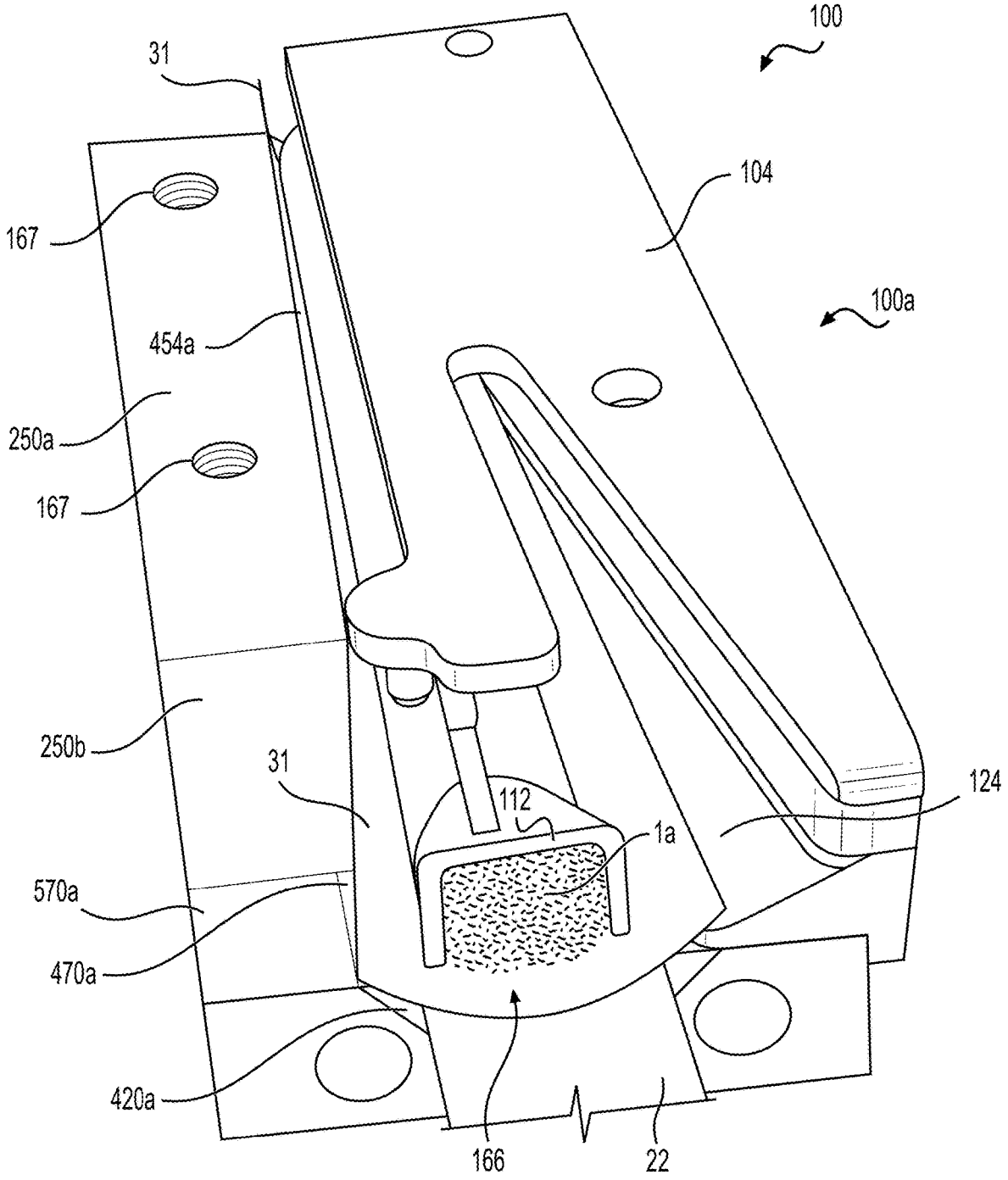
FIG. 7 is an illustration of a perspective view of the compression box of FIG. 6, with a lower belt and at least one covering shown passing through the compression box, in accordance with an example embodiment.

FIG. 7 is an illustration of a perspective view of the compression box 100 of FIG. 6, with the lower belt 22 and the at least one covering 31 shown passing through the compression box 100, in accordance with an example embodiment. In an example embodiment, and as discussed in relation to FIGS. 1-3, the tobacco column 1*a* travels down the channel 21 of the in-feed section 4 with a velocity that forces the tobacco column 1*a* to become compressed. As the tobacco column 1*a* enters the entrance 112 of the shaft 110 of the tongue assembly 100*a*, the lower belt 22 and the at least one covering 31 continue to drive the momentum and velocity of the tobacco column 1*a* to cause the tobacco column 1*a* to become compressed while flowing through the compression box 100. In an example embodiment, due to this momentum and velocity, the lower belt 22 and the at least one covering 31 impart a friction force on surfaces of the equipment in the finishing section 11 (FIG. 1), including imparting a friction force on the upper surfaces of the sections of the garniture (e.g., the garniture 150, or the garniture 550, or the garniture 551, etc.). The frictional forces from the movement and velocity of the lower belt 22 and/or the at least one covering 31 can produce heat which can wear and erode the garniture. By overlaying an insert (e.g., the insert 420, the insert 420*a*, the first insert portion 423*a* and/or the second insert portion 423*b*, as shown in at least FIGS. 5D, 5H, 5J and 5K) over some or all of the sections of the garniture, the insert can endure the heat and/or erosion. In an example embodiment, the insert can be replaced prior to the garniture being replaced, providing a significant cost savings, due to the comparative cost between the insert and the garniture. In an example embodiment, the width 472 of the insert 420*a* (FIG. 5J) is wide enough to prevent the at least one covering 31 and the lower belt 22 from contacting the upper surface 570*a* of the first section 550*a*, and the upper surfaces of the other sections of the garniture.

Figure 8:
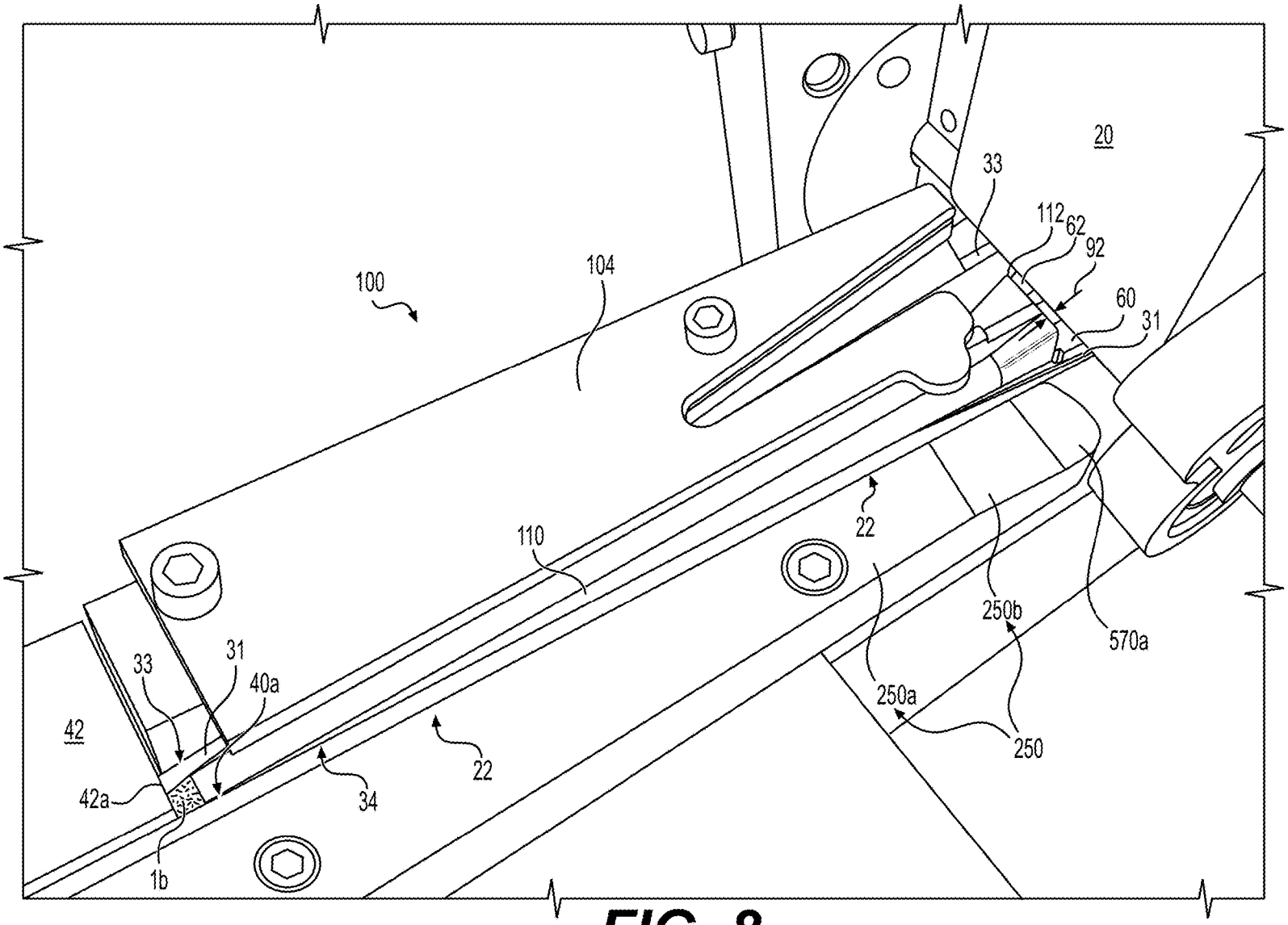
FIG. 8 is an illustration of a front end of the finishing section interfacing with an in-feed section, in accordance with an example embodiment.
Figure 9B:
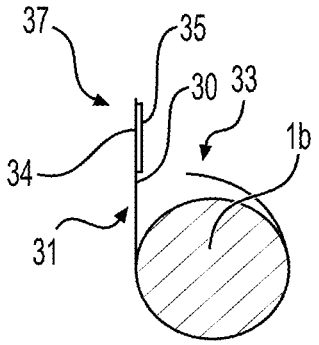
FIG. 9B is another illustration of a vertical cross-sectional view the tobacco rod being bound, in accordance with an example embodiment.
Figure 9C:
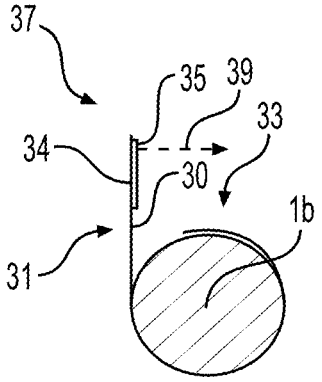
FIG. 9C is another illustration of a vertical cross-sectional view the tobacco rod being bound, in accordance with an example embodiment.
Figure 9D:
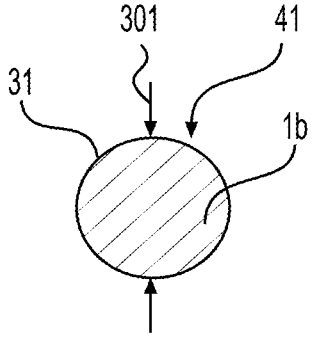
FIG. 9D is another illustration of a vertical cross-sectional view the tobacco rod being bound, in accordance with an example embodiment.

FIG. 8 is an illustration of a front end of the finishing section 11 interfacing with the in-feed section 4, in accordance with an example embodiment. In an example embodiment, the lower belt 22 and the at least one covering 31 move the tobacco column 1*a* (FIG. 7) into and through the entrance 112 of the compression box 100. Specifically, in an example embodiment, the first squeeze bar 60 and the second squeeze bar 62 guide the tobacco column 1*a* (not shown in this drawing), as the tobacco column 1*a* is propelled across a gap 92 between the in-feed belt 20 and the entrance 112, as the lower belt 22 transports the at least one covering 31 and the tobacco column 1*a* through the compression box 100.

In an example embodiment, the tobacco column 1*a* enters the entrance 112 of the compression box 100, and is compressed into the tobacco rod 1*b* as the tobacco passes through the compression box 100 (see FIGS. 9A and 9B, which correspond to view A-A and B-B of FIG. 1). In an example embodiment, as the at least one covering 31 exits the compression box 100, the free edge 37 of the at least one covering 31 is standing up vertically, and the lap edge 33 of the at least one covering 31 is beginning to become folded over onto a top portion of the tobacco rod 1*b* (see FIG. 9B). In an example embodiment, the adhesive applicator 40 (FIG. 1) applies the adhesive 35 to the at least one covering 31 at location 40*a*. In an example embodiment, as the tobacco rod 1*b* enters the short folder 42, an edge 42*a* of the short folder presses the lap edge 33 of the at least one covering 31 down onto the tobacco rod 1*b* more firmly (see FIG. 9C).

FIG. 9A is an illustration of a vertical cross-sectional view (view A-A of FIG. 1) the tobacco rod 1*b* being bound, in accordance with an example embodiment. In an example embodiment, and as shown in FIG. 9A, the tobacco rod 1*b* is formed by the tobacco column 1*a* flowing through the entrance 112 of the compression box 100, where the tobacco column 1*a* is transformed from a column with a square-shaped or a rectangular-shaped vertical cross-section (matching a vertical cross-section of the entrance 112) into the tobacco rod 1*b* with a circular-shaped vertical cross-section that is then pressed through the channel 166 of the compression box 100 (see FIGS. 7 and 8). To be clear, the tobacco rod 1*b* shown in FIG. 9A, is the vertical cross-sectional view of the tobacco rod 1*b* after the tobacco has passed through the entrance 112 of the shaft 110 of the tongue assembly 100*a*.

In an example embodiment, the lap (folded) edge 33 and free edge 37 of the at least one covering 31 remain extended, in a 'flared out' configuration relative to the tobacco rod 1*b* (as shown in FIG. 9A), where a mid-section 31*a* of the at least one covering 31 is contacting, and is partially wrapped around, a surface of the tobacco rod 1*b*, as the tobacco rod 1*b* enters the compression box 100.

FIG. 9B is another illustration of a vertical cross-sectional view (view B-B of FIG. 1) of the tobacco rod 1*b* being bound, in accordance with an example embodiment. In an example embodiment, and as shown in FIG. 9B, the tobacco rod 1*b* and the at least one covering 31 has already passed by the adhesive applicator 40, and the adhesive 35 has been applied to an upper (inner) surface of the free edge 37 of the at least one covering 31 (see FIG. 1). In an example embodiment, and as shown in FIG. 9B, the lap edge 33 is being folded toward the tobacco rod 1*b* as the tobacco rod 1*b* enters the short folder 42, where the short folder 42 at least partially assists in pinning the lap edge 33 down onto the tobacco rod 1*b*.

FIG. 9C is another illustration of a vertical cross-sectional view (view C-C of FIG. 1) of the tobacco rod 1*b* being bound, in accordance with an example embodiment. In an example embodiment, and in this configuration, the tobacco rod 1*b* has passed through the short folder 42 and is entering the finishing folder 44. In this configuration, the lap edge 33 has been folded over onto the tobacco rod 1*b*, and the free edge 37 of the at least one covering 31 is extended upward and is beginning to be folded (in direction 39) over the top of the lap edge 33 and the tobacco rod 1*b*.

FIG. 9D is another illustration of a vertical cross-sectional view (view D-D of FIG. 1) the tobacco rod 1*b* that has been bound into the finished rod 41, in accordance with an example embodiment. In an example embodiment, and in this configuration, the tobacco rod 1*b* has passed through the finishing folder 44, where the free edge 37 of the at least one covering 31 has been folded over onto the lap edge 33, and the lap edge 33 and free edge 37 are pinned together on the tobacco rod 1*b* by the adhesive 35.

In an example embodiment, following the finishing folder 44, the tobacco rod 1*b* enters the heater 46 so that the heater 46 may apply heat to the at least one covering 31, in order to cure the adhesive 35 and fuse the at least one covering 31 around the tobacco rod 1*b* to form the finished rod 41. In an example embodiment, the finished rod 41 leaves the heater 46 and enters the cutter 48, to cut sections of the finished rod 41 in order to form the consumer product 300 (FIG. 10).

FIG. 10 is an illustration of the consumer product 300 that is made from the rod forming apparatus 10, in accordance with an example embodiment. In an example embodiment, the consumer product 300 is a rolled tobacco product. In an example embodiment, the consumer product 300 has the desired diameter 301, as discussed herein. In an example embodiment, the consumer product 300 is a cigar. In an example embodiment, the consumer product 300 is a cigarette. In an example embodiment, the consumer product 300 is a filter, a tampon, or another cylindrically-shaped consumer product.

In an example embodiment, the tobacco 1 is shredded tobacco that is suitable for machine-made cigars. In an example embodiment, the tobacco 1 is blended pipe tobacco, or blended packing tobacco, that is suitable for packing a pipe. In an example embodiment, the tobacco 1 is a blend of various types of shredded, moist, tacky tobacco. In an example embodiment, the tobacco 1 is, for example, flue-cured tobacco, Burley tobacco, Maryland tobacco, Oriental tobacco, rare tobacco, specialty tobacco, reconstituted tobacco, or combinations thereof. In an example embodiment, the tobacco 1 is pasteurized. In another example embodiment, the tobacco 1 is fermented.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

I claim:

1. A garniture, comprising:

at least one first garniture section with a first longitudinal length and a first upper surface, a first groove being defined within the first upper surface along the first longitudinal length, the first groove being defined by one or more first mating surfaces;

at least one first insert overlaying the first groove, an upper end of the at least first insert defining a second groove within a second upper surface of the at least one first insert, a lower end of the at least one insert including one or more second mating surfaces, a first upper portion of the first upper surface and a second upper portion of the second upper surface being substantially flush with each other; and at least one second garniture section, a third groove being defined within a third upper surface of the at least one second garniture section, the at least one first garniture section and the at least one second garniture section being contiguously connected to each other so that the second groove is in communication with the third groove.

2. The garniture of claim 1, wherein the first upper portion of the first upper surface and the second upper portion of the second upper surface are substantially flat surfaces.

3. The garniture of claim 1, wherein each of the one or more first mating surfaces is connected to and flush with a respective one of the one or more second mating surfaces.

4. The garniture of claim 3, wherein no gaps exist between the one or more first mating surfaces and each respective one of the one or more second mating surfaces.

5. The garniture of claim 3, wherein each of the one or more first mating surfaces are flat surfaces that span across the first longitudinal length.

6. The garniture of claim 1, wherein the first groove has a first vertical cross-sectional profile with two or more flat sides, and each one of the two or more flat sides is at an obtuse angle relative to a directly adjacent one of the two or more flat sides.

7. The garniture of claim 1, wherein the one or more first mating surfaces includes:

a lower surface, the lower surface existing in a first plane that is about parallel with the first upper portion of the first upper surface, and a first surface and a second surface each extending from the lower surface to the first upper portion of the first upper surface, the first surface and the second surface each existing in respective planes that are at obtuse angles relative to the lower surface and the first upper portion of the first upper surface.

8. The garniture of claim 1, wherein the at least one first garniture section includes:

a first garniture section; and a second garniture section, the at least one first insert overlaying both the first garniture section and the second garniture section.

9. A garniture, comprising:

at least one first garniture section with a first longitudinal length and a first upper surface, a first groove being defined within the first upper surface along the first longitudinal length, the first groove being defined by one or more first mating surfaces;

at least one first insert overlaying the first groove, an upper end of the at least first insert defining a second groove within a second upper surface of the at least one first insert, a lower end of the at least one insert including one or more second mating surface, a first upper portion of the first upper surface and a second upper portion of the second upper surface being substantially flush with each other, the at least one first garniture section including a first garniture section and a second garniture section, the at least one first insert overlaying both the first garniture section and the second garniture section;

a third garniture section, a third groove being defined within a third upper surface of the third garniture section; and a fourth garniture section, a fourth groove being defined within a fourth upper surface of the fourth garniture section, wherein the first garniture section, the second garniture section, the third garniture section and the fourth garniture section are contiguously connected so that the second groove is in communication with the third groove and the fourth groove.

10. The garniture of claim 9, wherein the second groove, the third groove and the fourth groove each have an arcuate-shaped vertical cross-sectional profile, and a width of at least one of the second groove, the third groove or the fourth groove varies along a respective length of the first garniture section, the second garniture section, the third garniture section or the fourth garniture section.

11. The garniture of claim 9, wherein the second groove, the third groove and the fourth groove each have an arcuate-shaped vertical cross-sectional profile, and the third garniture section includes a first end and a second end, the third groove spanning from the first end to the second end, wherein a width of the third groove narrows from a first width on the first end to a second width on the second end of the third garniture section, the second groove and the fourth groove both having a third width that is equal to the second width.

12. The garniture of claim 1, wherein a third width of the second groove varies along the first longitudinal length of the at least one first garniture section.

13. The garniture of claim 1, wherein the second groove has a second vertical cross-sectional profile that is arcuate-shaped.

14. The garniture of claim 1, wherein the at least one first insert has a second longitudinal length, the second longitudinal length being a same length as the first longitudinal length.

15. The garniture of claim 1, wherein the at least one first insert has a second longitudinal length, and the at least one first insert is one continuous insert that does not include seams along the second longitudinal length.

16. The garniture of claim 1, wherein the at least one first garniture section defines at least one cooling hole that traverses through at least a portion of the at least one first garniture section.

17. The garniture of claim 16, wherein the at least one cooling hole is below the first groove, adjacent to the first groove, or below and adjacent to the first groove.

18. A garniture, comprising:

at least one first garniture section with a first longitudinal length and a first upper surface, a first groove being defined within the first upper surface along the first longitudinal length, the first groove being defined by one or more first mating surfaces; and at least one first insert overlaying the first groove, an upper end of the at least first insert defining a second groove within a second upper surface of the at least one first insert, a lower end of the at least one insert including one or more second mating surfaces, a first upper portion of the first upper surface and a second upper portion of the second upper surface being substantially flush with each other, the at least one first garniture section defining at least one cooling hole that traverses through a first end and a second end of the at least one first garniture section, the at least one cooling hole running through the first longitudinal length of the at least one first garniture section, and the first groove haing a fourth width and a first depth within the at least one first garniture section, the fourth width being about perpendicular to the first longitudinal length and the first depth being based on a lowest elevation of the first groove, and about 5% to about 35% of a total vertical cross-sectional area of the at least one cooling hole being within the fourth width and the first depth of the first groove.

19. The garniture of claim 18, wherein about 10% to about 25% of the total vertical cross-sectional area of the at least one cooling is within the fourth width and the first depth of the first groove.

20. The garniture of claim 16, wherein the at least one cooling hole includes:

a first cooling hole; and a second cooling hole, the first cooling hole and the second cooling hole being symmetrically positioned relative to the first groove.

21. A finishing section of a rod forming apparatus, comprising:

the garniture of claim 1;

finishing stations; and a lower belt, wherein the finishing stations are on the garniture, the lower belt being configured to travel through the second groove and between the garniture and the finishing stations.

22. The finishing section of claim 21, wherein the finishing stations include:

a compression box;

at least one folder; and a heater, wherein the at least one folder is on the at least one first garniture section.

23. The finishing section of claim 22, wherein the at least one first garniture section includes:

a first garniture section; and a second garniture section, the at least one first insert spanning across the first garniture section and the second garniture section.

24. The finishing section of claim 23, wherein the at least one second garniture further includes:

a third garniture section, the third garniture section having the third upper surface; and a fourth garniture section, a fourth groove being defined within a fourth upper surface of the fourth garniture section, wherein the first garniture section, the second garniture section, the third garniture section and the fourth garniture section are contiguously connected so that the second groove and the third groove are in communication with the fourth groove.

25. The finishing section of claim 24, wherein the compression box and the heater are on the third garniture section and the fourth garniture section, respectively.

26. The finishing section of claim 22, wherein the lower belt is configured to transport a column of tobacco on at least one covering through the finishing section, the compression box is configured to compress the column of tobacco into a tobacco rod, and the at least one folder is configured to longitudinally cover the tobacco rod with the at least one covering to form a wrapped tobacco rod, the wrapped tobacco rod having a desired diameter.

27. The finishing section of claim 21, wherein the lower belt is configured to transport a column of tobacco on at least one covering through the finishing section, and the finishing stations are configured to compress the column of tobacco into a tobacco rod and longitudinally wrap the tobacco rod with the at least one covering.

28. A finishing section of a rod forming apparatus, comprising:

a garniture, the garniture including at least one first garniture section with a first longitudinal length and a first upper surface, a first groove being defined within the first upper surface along the first longitudinal length, the first groove being defined by one or more first mating surfaces;

at least one first insert overlaying the first groove, an upper end of the at least first insert defining a second groove within a second upper surface of the at least one first insert, a lower end of the at least one insert including one or more second mating surfaces, a first upper portion of the first upper surface and a second upper portion of the second upper surface being substantially flush with each other;

finishing stations; and a lower belt, the finishing stations being on the garniture, the lower belt being configured to travel through the second groove and between the garniture and the finishing stations, the lower belt being configured to transport a column of tabacco on at least one covering through the finishing section, and the finishing stations being configured to compress the column of tabacco into a tobacco rod and longitudinally wrap the tobacco rod with the at least one covering, the garniture including at least one second garniture section, and the finish stations including, at least one first station that is configured to wrap the tobacco rod with the at least one covering, at least one second station that is configured to form the tobacco rod or further process the tobacco rod besides wrapping the tobacco rod, and the at least one first station is on the at least one first garniture section, and the at least one second station is on the at least one second garniture section.

29. The finishing section of claim 26, wherein a fifth width of the second upper portion of the second upper surface is wide enough to prevent the lower belt and the at least one covering from contacting the first upper portion of the first upper surface while the finishing section is in operational use.

30. The finishing section of claim 22, wherein each of the finishing stations is on the at least one first garniture section or the at least one second garniture section.

31. A rod forming apparatus, comprising:

the finishing section of claim 21;

a feed section;

an in-feed section; and a web section.

* * * * *